US009157709B2

(12) United States Patent
Nuetzman et al.

(10) Patent No.: US 9,157,709 B2
(45) Date of Patent: Oct. 13, 2015

(54) APPARATUS, SYSTEM, AND METHOD FOR MANUFACTURING AMMUNITION CARTRIDGE CASES

(71) Applicant: Setpoint Systems, Inc., Ogden, UT (US)

(72) Inventors: Steven E. Nuetzman, Syracuse, UT (US); Justin D. Carroll, Clearfield, UT (US); Robert H. Lundgreen, Jr., West Haven, UT (US); Nathan J. Morris, Ogden, UT (US); L. Scott Sheffield, Layton, UT (US); Warren L. Westphal, Roy, UT (US)

(73) Assignee: Setpoint Systems, Inc., Ogden, UT (US)

( * ) Notice: Subject to any disclaimer, the term of this patent is extended or adjusted under 35 U.S.C. 154(b) by 205 days.

(21) Appl. No.: 13/710,225

(22) Filed: Dec. 10, 2012

(65) Prior Publication Data

US 2013/0180392 A1 Jul. 18, 2013

Related U.S. Application Data

(60) Provisional application No. 61/568,419, filed on Dec. 8, 2011.

(51) Int. Cl.

| | |
|---|---|
| ***B21K 21/04*** | (2006.01) |
| ***F42B 5/28*** | (2006.01) |
| ***F42B 33/00*** | (2006.01) |
| ***F42B 33/14*** | (2006.01) |

(52) U.S. Cl.

CPC . *F42B 5/28* (2013.01); *F42B 33/00* (2013.01); *F42B 33/14* (2013.01)

(58) Field of Classification Search

CPC ..... F42B 33/002; F42B 33/00; F42B 33/14; B21K 21/04

USPC ..... 86/19.5, 19.6; 148/570

See application file for complete search history.

(56) References Cited

U.S. PATENT DOCUMENTS

| | | | | |
|---|---|---|---|---|
| 1,286,726 | A * | 12/1918 | Noble | 72/344 |
| 2,223,970 | A | 12/1940 | Stansel | |
| 2,303,408 | A | 12/1942 | Soderholm | |
| 2,356,236 | A | 8/1944 | Gagne, Jr. | |
| 2,373,921 | A * | 4/1945 | Snell | 86/19.5 |
| 2,387,698 | A | 10/1945 | Yost | |
| 2,430,005 | A | 11/1947 | Denneen et al. | |

(Continued)

OTHER PUBLICATIONS

Definition of "Stage". The American Heritage® Dictionary of the English Language, Fourth Edition copyright ©2000 by Houghton Mifflin Company. Updated in 2009.*

*Primary Examiner* — Gabriel Klein

(74) *Attorney, Agent, or Firm* — Kunzler Law Group

(57) ABSTRACT

The present disclosure relates to a system for forming a cartridge case, the system including a series of stages, each stage comprising a sequential location in the system, and each stage comprising a process step, wherein each process step is synchronized to occur within a substantially simultaneous stage interval, the stages including: an annealing stage, a head forming stage, and a taper stage. The present disclosure also relates to a method for manufacturing a cartridge case, the method including: receiving a single cartridge case at a time in a first direction into an annealing chamber through a first opening, passing an alternating current through an inductive coil for a certain time period to heat the cartridge case, releasing the cartridge case from the annealing chamber in the first direction through a second opening, and performing a forming step on the cartridge case.

18 Claims, 20 Drawing Sheets

(56) References Cited

U.S. PATENT DOCUMENTS

| | | | | | |
|---|---|---|---|---|---|
| 2,439,517 | A | | 4/1948 | Johnson | |
| 2,620,433 | A | * | 12/1952 | Denneen et al. | 219/643 |
| 2,907,858 | A | | 10/1959 | Distler | |
| 2,991,881 | A | * | 7/1961 | Craven | 209/630 |
| 3,005,894 | A | | 10/1961 | Carbo et al. | |
| 3,156,011 | A | | 11/1964 | Olson | |
| 3,408,718 | A | * | 11/1968 | William | 86/19.5 |
| 3,452,578 | A | * | 7/1969 | Olivier et al. | 72/348 |
| 3,628,225 | A | * | 12/1971 | Parker | 86/19.5 |
| 3,829,650 | A | | 8/1974 | Armstrong | |
| 4,090,698 | A | | 5/1978 | Mucha et al. | |
| 4,117,539 | A | | 9/1978 | Bell et al. | |
| 4,593,598 | A | | 6/1986 | Gunder | |
| 4,633,720 | A | | 1/1987 | Dybel et al. | |
| 4,638,535 | A | * | 1/1987 | Pryor et al. | 86/19.5 |
| 4,693,109 | A | | 9/1987 | Connor et al. | |
| 4,723,472 | A | | 2/1988 | Lee | |
| 4,819,476 | A | | 4/1989 | Bakermans et al. | |
| 4,923,066 | A | | 5/1990 | Ophir et al. | |
| 4,987,528 | A | | 1/1991 | O'Brien | |
| 5,048,162 | A | | 9/1991 | Nelson | |
| 5,079,986 | A | | 1/1992 | Lee | |
| 5,095,731 | A | * | 3/1992 | Greslin | 72/361 |
| 5,299,463 | A | | 4/1994 | Gross | |
| 5,315,752 | A | | 5/1994 | Ohta et al. | |
| 5,423,199 | A | | 6/1995 | Mangrulkar | |
| 5,493,888 | A | | 2/1996 | Merkle et al. | |
| 5,564,298 | A | | 10/1996 | DeMeo | |
| 5,635,661 | A | | 6/1997 | Tuftee | |
| 5,661,656 | A | | 8/1997 | Goldman | |
| 5,715,721 | A | | 2/1998 | Anders et al. | |
| 5,941,111 | A | | 8/1999 | Skala et al. | |
| 6,122,565 | A | | 9/2000 | Wenning et al. | |
| 6,177,662 | B1 | | 1/2001 | Rutledge | |
| 6,192,561 | B1 | | 2/2001 | Bennett | |
| 6,261,082 | B1 | | 7/2001 | Han | |
| 6,311,597 | B1 | | 11/2001 | Schroth et al. | |
| 6,397,718 | B2 | | 6/2002 | Jaamison et al. | |
| 6,467,356 | B1 | | 10/2002 | Schoch | |
| 6,484,106 | B1 | | 11/2002 | Schoch | |
| 6,530,256 | B1 | | 3/2003 | Irie et al. | |
| 6,535,825 | B1 | | 3/2003 | Okano | |
| 6,619,088 | B1 | | 9/2003 | Oyamada et al. | |
| 6,620,374 | B2 | | 9/2003 | Stefanac et al. | |
| 7,024,978 | B1 | | 4/2006 | Helinski | |
| 7,073,364 | B2 | | 7/2006 | Krish, Sr. et al. | |
| 7,112,049 | B2 | | 9/2006 | Fueller et al. | |
| 7,114,365 | B2 | | 10/2006 | Rooney et al. | |
| 7,854,188 | B1 | | 12/2010 | Buckley | |
| 8,707,844 | B2 | * | 4/2014 | Eveland | 86/19.7 |
| 2006/0016524 | A1 | | 1/2006 | Scharch | |
| 2011/0094279 | A1 | | 4/2011 | Suzuki et al. | |
| 2012/0145288 | A1 | * | 6/2012 | Stratford | 148/565 |
| 2013/0152771 | A1 | * | 6/2013 | Coma Asensio | 86/19.5 |

* cited by examiner

APPARATUS, SYSTEM, AND METHOD FOR MANUFACTURING AMMUNITION CARTRIDGE CASES

CROSS-REFERENCES TO RELATED APPLICATIONS

This application claims the benefit of U.S. Provisional Patent Application No. 61/568,419 entitled "Apparatus, System, and Method for Manufacturing Ammunition Cartridge Cases" and filed on Dec. 8, 2011 for Nuetzman, et. al., which is incorporated herein by reference.

FIELD

This invention relates to ammunition cartridge case manufacturing.

BACKGROUND

Many types of small arms ammunition include a cartridge that includes a cartridge case that houses a primer, powder, and a projectile often called a bullet. Various dimensions and aspects of a cartridge case can affect how a bullet behaves when it comes out of a gun. Thus, for consistency for accurately hitting a target as well as safety for a shooter it can be quite important that the dimensions and other aspects of a cartridge case be substantially uniform and/or meet precise cartridge case requirements.

Traditional cartridge case manufacturing methods include putting a plurality of cartridge cases through a cartridge processing step at the same time. For example, two or more cartridges may be pressed and/or heated at the same time. This may lead to difficult control of the specific treatment of a specific cartridge. For example, variables in a single cartridge may affect how another cartridge is processed. One cartridge case may be harder, softer, warmer, cooler, or have different dimensions than another cartridge case. By processing them at the same time the variations between the cartridge cases may not be accounted for and one or both of the cartridge cases may be improperly treated and may result in errors that require a rejection of the cartridge cases. Additionally, mechanisms that heat or press two different parts at the same time often do not treat the parts exactly the same. For example, the temperature of an oven may not be completely uniform and may result in one cartridge case being heated to a different temperature than another cartridge case.

Other variations in the ambient environment and/or in a press or machine may also cause variations with how cartridge cases are processed. For example, warmer temperatures may result in a press or other device to slightly change dimensions and thus create a cartridge case having different dimensions. Thus, a cartridge case processed by a machine (e.g. stamper, press, device) that has not yet achieved a desired operating temperature may not meet desired cartridge case specifications. In some instances, large numbers of cases may be processed with the expectation of treating them as scrap until a machine, press, or device has reached a desired operating condition (i.e. a device has achieved the proper temperature).

Additionally, traditional cartridge case manufacturing methods often include processing a cartridge case in a press which then ejects the cartridge case into a bin. The cartridge cases in the bin may then be placed on a conveyor to a next press or may be carted by a worker off to another press or process step. Thus, at the next press the cartridge case orientation must be adjusted or oriented according to the requirements for the next process. This can add unwanted time, expense, and/or complexity to the process because a cartridge case must be repeatedly reoriented. Additionally, spitting cartridges out into bins may result in damage to cartridge casings which may result in the creation of more scrap materials and monetary loses.

Further, traditional cartridge case forming methods often include unpredictable time periods between method or process steps. For example, a certain step in a conventional process may create a bottleneck in the system, thus cartridge cases may have to sit in waiting for minutes, hours, days, or even weeks before moving to the next process step. These variations can lead to wide ranges of different operating temperatures and or other aspects. In one embodiment, lube that is placed on a cartridge case for a process step may, over time, attract dirt, loose viscosity, lose lube properties, and/or harden. These variations can significantly affect how a cartridge case responds to forming steps such as press, stamp, punch, or taper forming steps.

SUMMARY

From the foregoing discussion, it should be apparent that a need exists for an apparatus, system, and method for manufacturing cartridge casings. Beneficially, such an apparatus, system, and method would efficiently, effectively, and consistently manufacture cartridge cases.

The subject matter of the present application has been developed in response to the present state of the art, and in particular, in response to the problems and needs in the art that have not yet been fully solved by currently available cartridge manufacturing processes. Accordingly, the present disclosure has been developed to provide an apparatus, system, and method for making cartridge cases that overcome many or all of the above-discussed shortcomings in the art.

The subject matter of the present disclosure relates to a system for forming a cartridge case, the system including a series of stages, each stage comprising a sequential location in the system, and each stage comprising a process step, wherein each process step is synchronized to occur within a substantially simultaneous stage interval, the stages including: an annealing stage where an annealing step is performed, a head forming stage where a head forming step is performed, and a taper stage where a taper forming step is performed. The cartridge case is sequentially transferred through the series of stages and the cartridge case is maintained with a controlled orientation within and between the series of stages.

The system may be configured so that the distance traveled between stages is less than twelve feet. Also, the head forming step may include press forming a head of the cartridge case with a press, the press actuated by a servo motor. The cartridge case may also be seated in a die nest during press forming, and the die nest may be monitored by a load cell. The system may also have a stage interval with a duration determined by the completion of one or more process steps.

The system may also include a testing step that is performed at one of the stages, the testing determining whether a cartridge case passes or fails a testing criterion. The testing step may further include an output stage where an output step is performed, wherein the output step involves selectively outputting the cartridge case to one of: a fail location, a pass location, and a quality control location. The taper forming step may be altered for the cartridge case based on one or more tests of one or more previous cartridge cases. The taper forming step may also be altered based on a test of a cartridge case that passed a testing criterion.

The system may maintain the cartridge case with the open side down during the tapering stage. Also, the system may maintain the cartridge case with the open side down within and between the head forming stage and the taper stage. Additionally, a testing step may be performed at one of the stages, the testing step including taking a first picture of a cartridge case, rotating the cartridge case by about 90 degrees, and taking a second picture of the cartridge case. The system may further maintain the cartridge case in a controlled orientation regardless of whether the cartridge case remains in an identical orientation.

The system may also include an extractor groove forming stage. The annealing stage may include an inductive coil and a coil insert, the insert encompassing the sides of an annealing chamber. The coil insert may be constructed of a non-conductive or non-magnetic material. The annealing module may further include a casing enclosing and supporting the inductive coil and the casing may be constructed of a non-conductive or non-magnetic material. Additionally, the annealing chamber may include a first opening and a second opening, wherein a cartridge case is allowed to pass into the annealing chamber through the first opening and out of the annealing chamber through the second opening and the second opening may include a release mechanism.

The present disclosure also relates to a method for manufacturing a cartridge case, the method including: receiving a single cartridge case at a time in a first direction into an annealing chamber through a first opening, passing an alternating current through an inductive coil for a certain time period to heat the cartridge case, releasing the cartridge case from the annealing chamber in the first direction through a second opening, and performing a forming step on the cartridge case. The method may involve unevenly heating the cartridge so that the cartridge case obtains at least a first hardness at a first location and a second hardness at a second location, the first hardness different from the second hardness. The first direction may also comprise a substantially downward vertical direction.

In the method the time period during which an alternating current is passed through the inductive coil is less than about two seconds. In another example, certain time period during which an alternating current is passed through the inductive coil is between about 500 milliseconds and 800 milliseconds. The passing an alternating current through an inductive coil may include balancing a plurality of factors to get a desired gradient, the plurality of factors comprising two or more of an amplitude of the current, a wave shape of the current, a frequency of the current, an overall length of a signal, the geometry of the cartridge case, a size of the larger diameter portion, a size of the smaller diameter portion, and a diameter of tubing that forms the inductive coil. The method may also include an inductive coil that has a larger diameter portion and a smaller diameter portion and the method may also include monitoring the temperature of the cartridge case.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
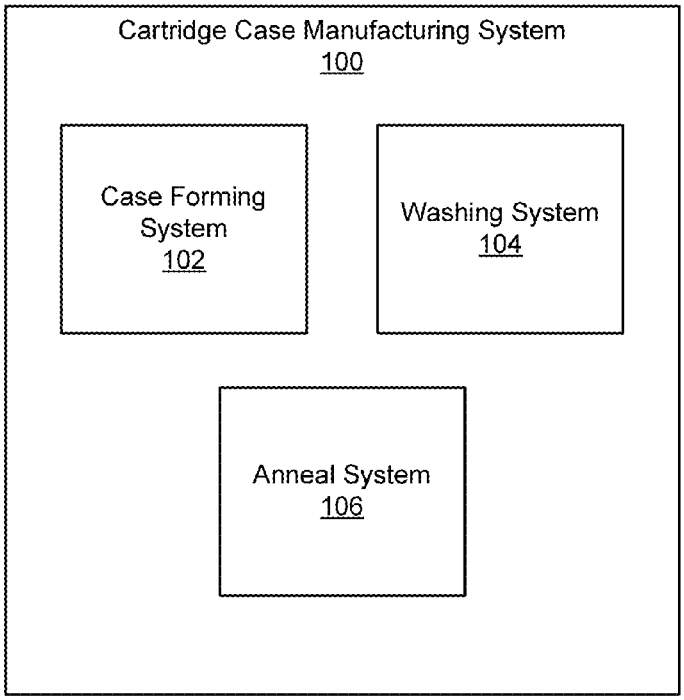
FIG. 1 is a schematic block diagram illustrating one embodiment of a cartridge case manufacturing system in accordance with the present invention.

FIG. 1 is a schematic block diagram illustrating one embodiment of a cartridge case manufacturing system 100. The cartridge case manufacturing system 100 may be used in the manufacturing of an ammunition cartridge case. In one embodiment, the cartridge case manufacturing system 100 may perform one or more steps on a metallic cartridge case tube to form an ammunition cartridge case. According to one embodiment, the cartridge case manufacturing system 100 may perform one or more annealing, testing, washing, and forming steps.

Figure 2:
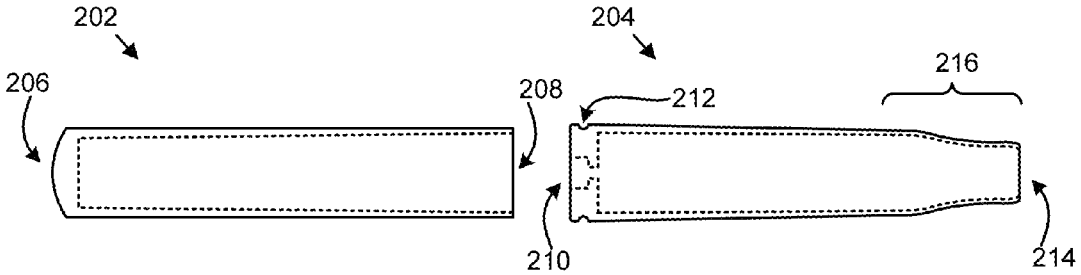
FIG. 2 includes cross-sectional side views of a cartridge case tube and a formed cartridge case in accordance with the present invention.

FIG. 2 illustrates one embodiment of a cartridge case tube 202 and a formed cartridge case 204. Solid lines indicate an outside profile of the tube 202 and the case 204 while dotted lines indicate internal dimensions along a cross section. According to one embodiment, a cartridge case tube 202 may be provided into the cartridge case manufacturing system 100 which then performs one or more steps in the process of creating the formed cartridge case 204. In one embodiment, the cartridge case tube 202 and the formed cartridge case 204 comprise brass.

In one embodiment, the cartridge case tube 202 has a tubular shape with closed end 206 and an open end 208. In one embodiment, the cartridge case manufacturing system 100 may perform one or more steps or operations to form the cartridge case 204 from the cartridge case tube 202. A formed cartridge case 204 may include a primer pocket 210 with a vent hole, an extractor groove 212, an open end 214, and a tapered neck 216 at the open end 214. The formed cartridge case 204 may also include a proper hardness or softness at different portions based on one or more heat treatment or annealing steps. As will be understood by one skilled in the art the depicted cartridge case tube 202 and formed cartridge case 204 are exemplary only. The dimensions and features of the cartridge case tube 202 and the formed cartridge case 204 can vary considerably and are provided for illustrative purposes only.

As used herein the terms cartridge case, cartridge casing, or case are given to mean a cartridge case tube, a formed cartridge case, or a cartridge case at any stage after one or more steps have been performed on the cartridge case tube 202. It will be understood by one skilled in the art that as one or more steps are performed on a cartridge case it may still not be in a finished state and may not properly be called either a cartridge case tube or a formed cartridge case. For this reason, the terms cartridge case, cartridge casing, and case should be interpreted broadly as referring to the metal material at any point along the process of forming a finished cartridge case. If specific references to a cartridge case tube 202 or a formed cartridge case 204 are desired such reference will be made explicit.

Returning to FIG. 1, the cartridge case manufacturing system 100 may be used to create a cartridge case that is in condition for assembly into a finished cartridge or ammunition round. For example, the cartridge case manufacturing system 100 may place a cartridge case in condition for being assembled with a primer, powder, and/or bullet to create a ready to use cartridge or ammunition round. In one embodiment, the cartridge case manufacturing system 100 may be configured to create a cartridge case that meets cartridge case requirements for a specific type of ammunition. For example, the formed cartridge case 204 may have a hardness profile similar to one of the hardness profiles described below with reference to FIG. 13. In one embodiment, the cartridge case manufacturing system 100 includes a forming system 102, a washing system 104, and an anneal system 106.

The cartridge case manufacturing system 100 may include a case forming system 102. The cartridge case forming system 102 may form or shape a cartridge case to have dimensions and a shape of a finished cartridge case. In one embodiment, the case forming system 102 performs one or more heating and or shaping steps to transform a cartridge case tube into a finished cartridge case. In one embodiment, the forming system 102 performs steps to only partially finish a cartridge case. For example, the forming system 102 may perform steps to form a cartridge case having required dimensions but may not have a required hardness or other property. Further discussion of the case forming system 102 will provided in relation to later figures.

The cartridge case manufacturing system 100 may include a washing system 104. The washing system 104 may be configured to wash one or more cartridge cases. In one embodiment, a process of the cartridge forming system 102 may result in lube, dust, or other residue being on a cartridge case. The washing system 104 may wash any residue from the cartridge case for later handling. In one embodiment, the washing system 104 may also apply an anti-tarnish finish to a cartridge case. In one embodiment, the washing of the residue may allow for a more accurate anneal by the anneal system 106. In one embodiment, the washing system 104 may be an automated washing system configured to receive cartridge cases, wash them, and provide them to a later module, such as the anneal module 106, or a conveyor or bin.

The cartridge case manufacturing system 100 may include an anneal system 106. The anneal system 106 may be configured to perform one or more hardening, softening, and/or stress relieving heat treatments on a cartridge case. In one embodiment, the anneal system 106 is configured to perform one or more final heat treating steps on a cartridge case. In one embodiment, the anneal system 106 performs one or more heat treating steps on a formed cartridge case. For example, the cartridge case may have been formed to final dimensions by the cartridge forming system 102 prior to receipt by the anneal system 106. Further discussion and description of the anneal system 106 will be discussed further in relation to later figures.

Figure 3:
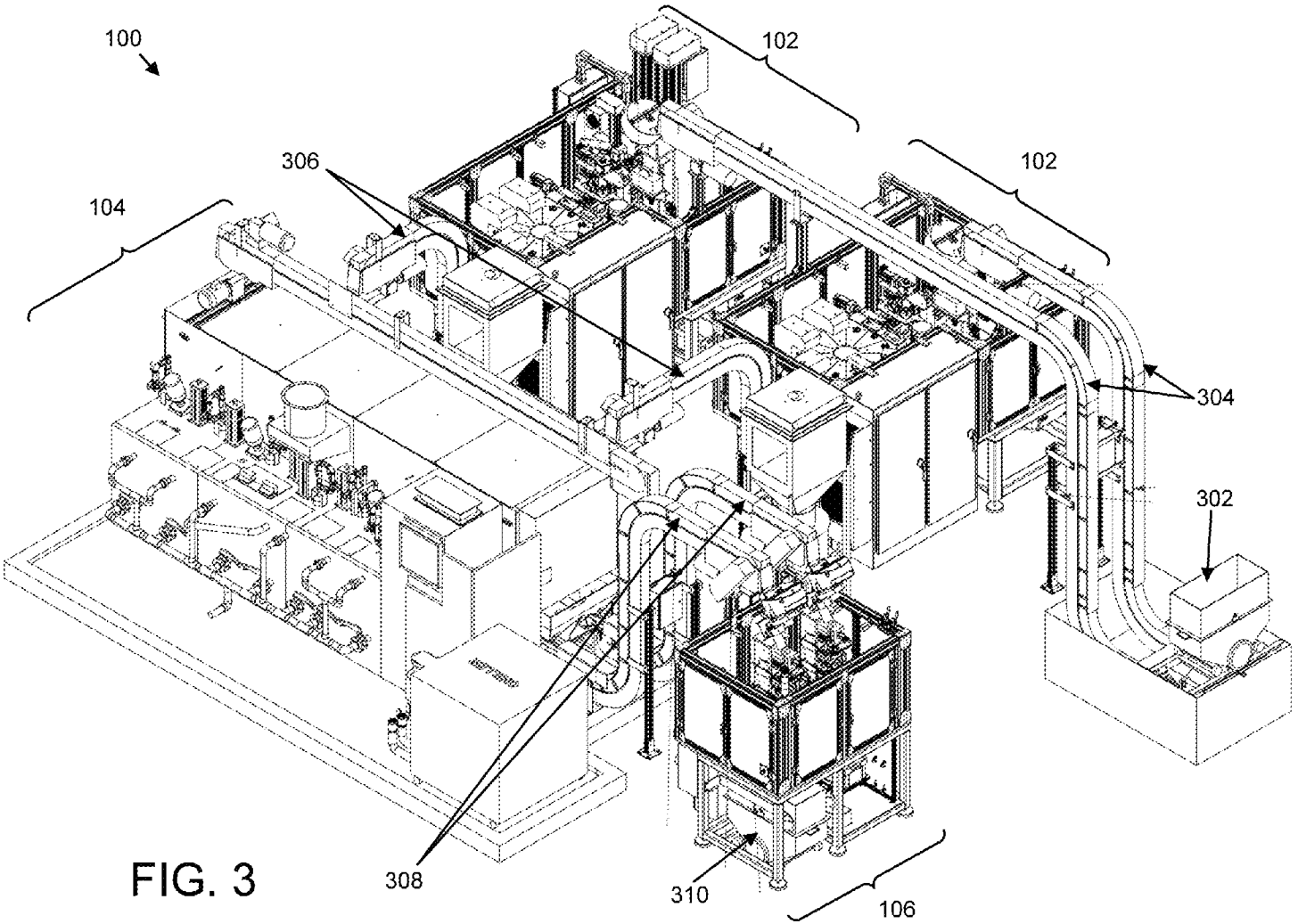
FIG. 3 is a perspective view of one embodiment of a cartridge case manufacturing system.

FIG. 3 is a perspective view of one embodiment of a cartridge case manufacturing system 100. In the depicted embodiment, the cartridge case manufacturing system 100 includes two case forming systems 102, a washing system 104, and an anneal system 106. The system 100 is also depicted including an input station 302, conveyors 304, 306, 308, and an output station 310.

In one embodiment, cartridge case tubes are placed in a bin at an input station 302. The cartridge case tubes may then be transported to the forming systems 102 via conveyors 304 where one or more forming steps may be performed. Following one or more steps by the case forming system 102 conveyors 306 may transport cartridge cases to the washing system 104. Following washing of the cartridge cases the conveyors 308 may transport the cases to the anneal system 106. The anneal system 106 may output the cartridge cases to an output station 310 or bin.

Figure 4:
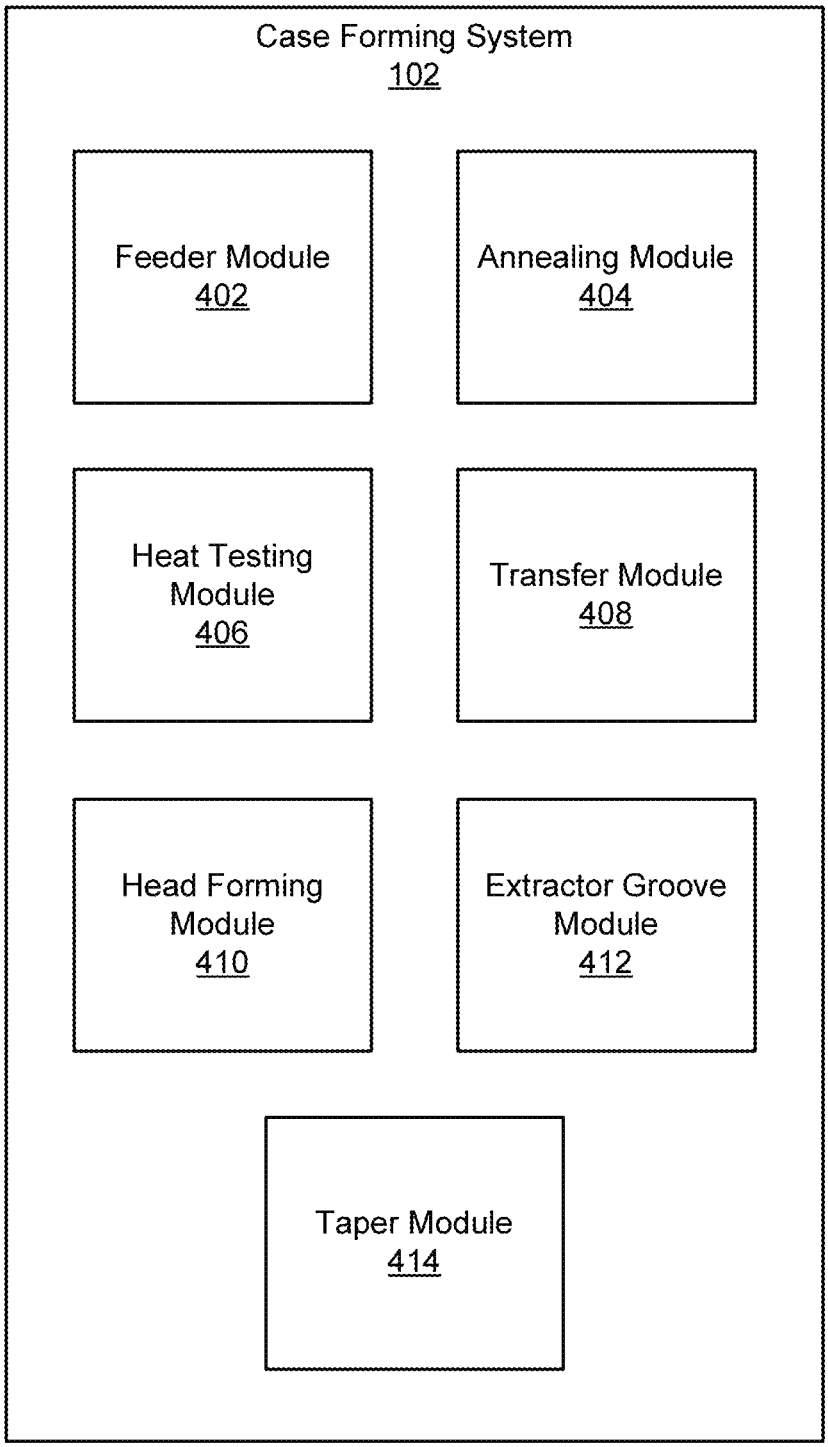
FIG. 4 is a schematic block diagram illustrating one embodiment of a cartridge forming system in accordance with the present invention.

FIG. 4 is a schematic block diagram illustrating one embodiment of a case forming system 102. In one embodiment, the case forming system 102 may perform one or more steps on a metallic cartridge case tube to form an ammunition cartridge case. According to one embodiment, the case forming system 102 may perform one or more annealing, testing, and forming steps.

In one embodiment, the cartridge forming system 102 includes a feeder module 402, an annealing module 404, a testing module 406, a transfer module 408, a head forming module 410, an extractor groove module 412, and a taper module 414. The modules 402-414 are exemplary only and may not all be included in all embodiments. In fact, some embodiments may include one or more of the modules 402-414 in any combination without limitation.

The case forming system 102 may include a feeder module 402. In one embodiment, the feeder module 402 feeds a cartridge case into an annealing module 404. In one embodiment, the feeder module 402 may feed a cartridge case into the annealing module 404 in a controlled orientation. For example, the feeder module 402 may receive a cartridge case in a random orientation and may orient the cartridge case into a predefined orientation. In one embodiment, the feeder module 402 may receive a cartridge case in a controlled orientation and maintain a controlled orientation as the cartridge case is fed into the annealing module.

In one embodiment, the feeder module 402 may feed a single cartridge case at a time into the annealing module 404. In one embodiment, the feeder module 402 may feed cartridge cases one at a time upon some interval, such as a predefined interval or a variable interval. In one embodiment, the feeder module 402 feeds a cartridge case into the annealing module 404 upon receiving a command to feed an additional cartridge case. In one embodiment, the feeder module 402 may include a collator, tube, singulation and release mechanism, and/or a plurality of other mechanisms for feeding a cartridge case into the feeder module.

The case forming system 102 may include an annealing module 404. The annealing module 404 may heat a cartridge case. In one embodiment, a single cartridge case may be heated at a time. In one embodiment, a cartridge case may be heated to obtain a desired hardness or softness, reduce stress within the material of the cartridge case, and/or create a substantially similar starting point for cartridge cases in preparation for one or more forming steps. In one embodiment, the cartridge case is heated to create a desired uniform or non-uniform hardness within the material of a cartridge case. Further discussion and detail of the annealing module 404 will be provided in relation to additional figures.

The case forming system 102 may include a heat testing module 406. The heat testing module 406 may test the temperature of a cartridge case heated by the annealing module 404. In one embodiment, the heat testing module 406 may verify that the cartridge case was heated to a desired temperature. The heat testing module 406 may test for a desired heat gradient and/or may record temperatures to track any variations of heating between cartridge cases. The heat testing module 406 may include a non-contact heat testing device or mechanism. For example, the heat testing module may include a non-contact thermometer such as a non-contact laser thermometer or an infrared thermocouple.

The heat testing module 406 may perform a heat test at any point within the case forming system 102 or at any stage within a process performed by the case forming system 102. In one embodiment, the heat testing module 406 performs a heat test while a cartridge case is still within or being held by the annealing module 404. In one embodiment, the heat testing module 406 may test the heat of a cartridge case after the cartridge case has left the annealing module 404. For example, the heat testing module 406 may perform a heat test when the annealing module 404 releases a cartridge case and/or after a transfer module 408 receives a cartridge case.

The case forming system 102 may include a transfer module 408. In one embodiment, the transfer module 408 may include one or more mechanisms or devices for transferring a cartridge case from the annealing module 404 to a head forming module 410. In one embodiment, the transfer module 408 may transfer a cartridge case to some other device or mechanism.

In one embodiment, the transfer module 408 may maintain a cartridge case in a controlled orientation. According to one embodiment, the transfer module 408 may receive a cartridge case in a controlled orientation and may maintain the controller orientation during transfer to a head forming module 410.

In one embodiment, the transfer module 408 may include a cooling station for allowing a cartridge case to cool. In one embodiment, the transfer module 408 may allow a cartridge casing to cool until it reaches a dimensionally stable temperature. For example, if a cartridge case is extremely hot it may have different dimensions than if the cartridge case were at room temperature or even fairly close to room temperature. Additionally, a cartridge case may have significantly different hardness or softness at different temperatures. In one embodiment, allowing a cartridge case to cool allows it to hit a temperature where it will have more consistent material characteristics. This may be important for consistency in forming a plurality of cartridge cases.

In one embodiment, a cooling station may include a cooling rack upon which one or more cartridge cases may be placed. For example, a plurality of cartridge cases may be on the cooling rack at any one time. As a cartridge case is released from the annealing module 404 and placed on the cooling rack another cartridge case may be removed from the cooling rack and transferred to a head forming module 410. In one embodiment, the cartridge cases may be air cooled.

The case forming system 102 may include a head forming module 410. The head forming module 410 may perform one or more head forming steps. For example, the head forming module 410 may perform one or more stamp, press, and/or punch operations on the closed end 206 of a cartridge tube 202 to form a head of a cartridge case 204 that includes a pocket, vent hole, identification symbols, or other attributes of a finished cartridge case. The head forming module 410 may also include one or more testing devices to test whether one or more head forming steps were properly performed.

The case forming system 102 may include an extractor groove module 412. The extractor groove module 412 may form an extractor groove on a cartridge case. For example, the extractor groove 212 of the finished cartridge case 204 may be formed by an extractor groove module 412. The extractor groove module 412 may perform one or more groove forming steps. In one embodiment, the extractor groove module 412 may include a chuck that is used to turn a cartridge case against a blade or work surface to form an extractor groove. The extractor groove module 412 may also include one or more testing devices or steps to check whether an extractor groove was properly formed.

The case forming system 102 may include a taper module 414. The taper module 414 may perform one or more press operations to form a tapered neck. For example, the taper module 414 may perform a press operation which forms the tapered neck 216 of the finished cartridge case 204 of FIG. 2. The taper module 412 may include one or more testing devices or steps to check whether a tapered neck was properly formed.

According to one embodiment, the cartridge forming system 102 is configured to maintain a controlled orientation of a cartridge case from the time it is fed into the annealing module 404 to the time it is transferred out of the taper module 414. In one embodiment, maintaining a controlled orientation means maintaining a cartridge case in substantially the same orientation although it may be moved laterally and/or vertically. In one embodiment, maintaining a controlled orientation means maintain control of the orientation of the cartridge case, even if the orientation and/or position of the cartridge case may be altered. For example, in one embodiment, a cartridge case moves along a pre-determined path as the change in orientation is controlled by one or more modules or mechanisms of the case forming system 102

Figure 5:
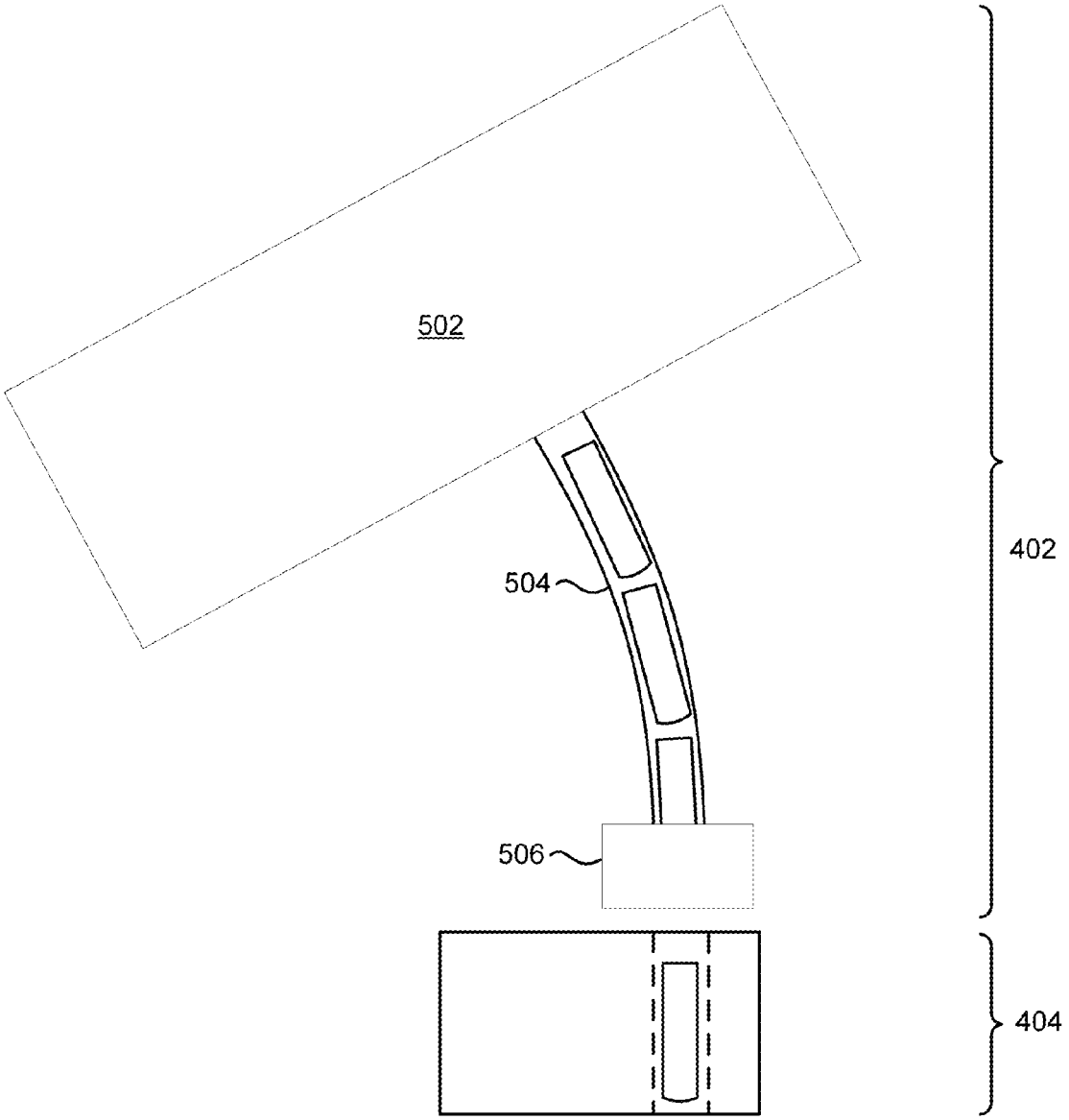
FIG. 5 illustrates a side view of one embodiment of an feeder module in accordance with the present invention.

FIG. 5 illustrates one embodiment of a feeder module 402. The feeder module 402 may be configured to feed a cartridge case into an annealing module 404. In the depicted embodiment, the feeder module 402 includes a collator 502, a feeder tube 504, and a singulation gate 506.

The collator 502 may be configured to receive a cartridge case in an uncontrolled orientation and dispense the cartridge case in a controlled orientation. In one embodiment, a cartridge case may be fed by a conveyor, such as conveyor 304 of FIG. 3, into the collator 502. The collator 502 may then dispense the cartridge case into the feeder tube 504 in a controlled orientation. One embodiment of a collator is sold by Howell Company of Lewiston, Id.

In one embodiment, a cartridge case is dispensed into the feeder tube 504 with a heavy end down. For example, the closed end 206 of the cartridge tube 202 of FIG. 2 may be heavier than the open end 208. If a cartridge tube 202 is fed into the collator 502 the collator may orient the cartridge tube 202 into a vertical orientation with the closed end down 206 and dispense the cartridge tube into the feeder tube 504.

In one embodiment, the collator 502 may continue to dispense cartridge cases into the feeder tube 504 until the feeder tube 504 is full. In one embodiment, a sensor may provide a signal to the collator 502 to indicate additional cartridge cases are needed. In one embodiment, by keeping the feeder tube 504 full there may always be a cartridge case ready for feeding into the annealing module 404.

The singulation gate 506 may selectively release a cartridge case into the feeder module. For example the singulation gate 506 may receive a signal when the annealing module 404 is ready for an additional cartridge case in which case the singulation gate 506 may open to allow a cartridge case to be fed into the annealing module. In one embodiment, the singulation gate 506 may simply include a trap door or other type of mechanism that allows a cartridge case to drop into the annealing module 404 due to gravity. In one embodiment, the singulation gate 506 may provide a force to eject the cartridge case into the annealing module 404. For example, pressurized air may be used to force the cartridge case into the annealing module 404.

One of skill in the art will recognize that the feeder module 402 of FIG. 5 is exemplary only. Significant variation is possible without departing from the scope of the present disclosure.

Figure 6:
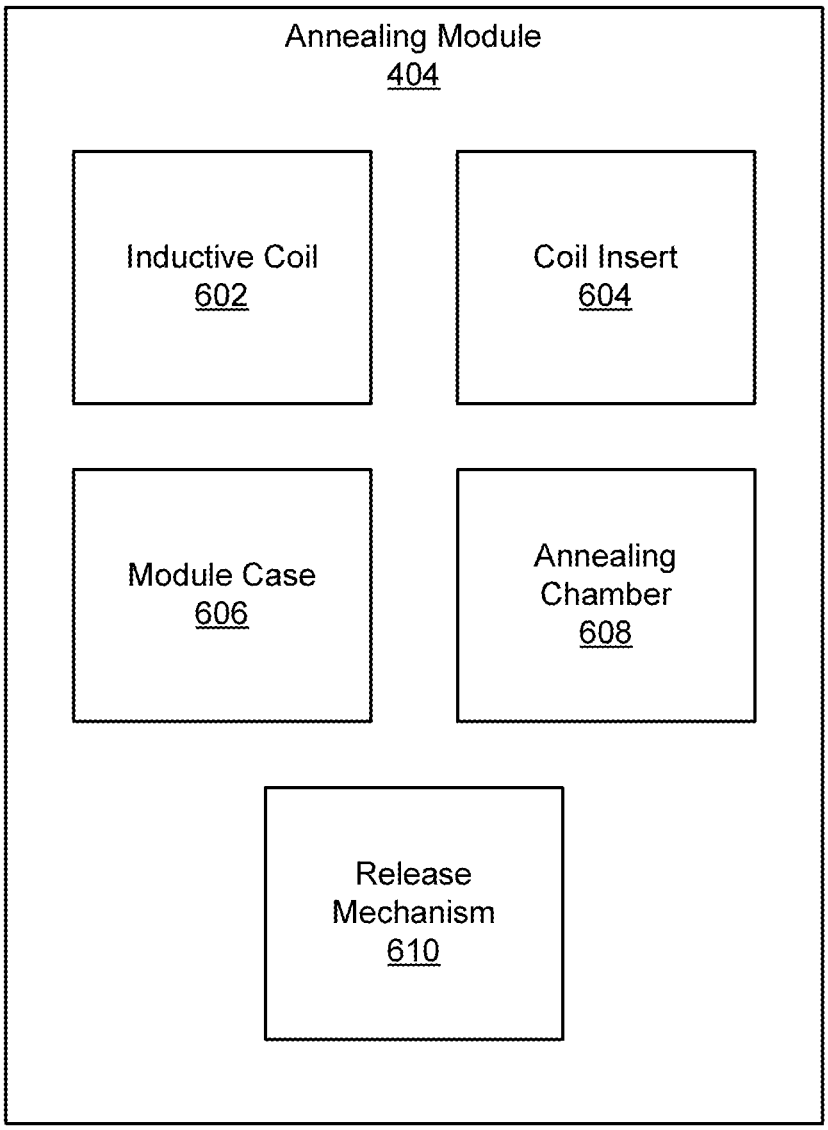
FIG. 6 is a schematic block diagram illustrating one embodiment of an annealing module in accordance with the present invention.

Turning to FIG. 6 a schematic block diagram illustrating exemplary components and features of an annealing module 404 is illustrated. As previously mentioned, the annealing module 404 may be used to heat a cartridge case to obtain a desired hardness or softness, reduce stress within the material of the cartridge case, and/or create a substantially similar starting point for materials in cartridge cases in preparation for one or more forming steps. In one embodiment, the annealing module 404 may create a substantially uniform hardness of a cartridge case. In one embodiment, the annealing module 404 creates a non-uniform hardness in a cartridge case. For example, a cartridge case may be heated such that it has a different hardness at two different points. A cartridge case may be heated such that it has a hardness grating that varies along the length of a cartridge case, from one end to the other.

In one embodiment, the annealing module 404 may receive a cartridge case in a first direction and release the cartridge case and allow it to continue along in the first direction. In one embodiment, the annealing module 404 may include a through-hole chamber that allows a cartridge case to be received through one opening and released through a second opening. According to one embodiment, this may allow for quick and controlled entry and release of a cartridge case. It may also allow for controlled orientation following the heating of a cartridge case. Exemplary components, features, and configurations of the annealing module 404 will now be discussed.

In the depicted embodiment of FIG. 6, the annealing module 404 includes an inductive coil 602, a coil insert 604, a module case 606, an annealing chamber 608, and a release mechanism 610. The components and features 602-610 are exemplary only and may or may not be included. In varying embodiments, one or more of the components and features 602-610 in any combination may be included in an annealing module 404.

The annealing module 404 may include an inductive coil 602 for heating a cartridge case. In one embodiment, the inductive coil may be energized with electrical power to create a changing magnetic field. The changing magnetic field may then induce currents within a conductive or magnetic material such as a cartridge case placed in the magnetic field. Induced currents and other effects may then cause heat to be generated within the conductive or magnetic material.

Figure 7A:
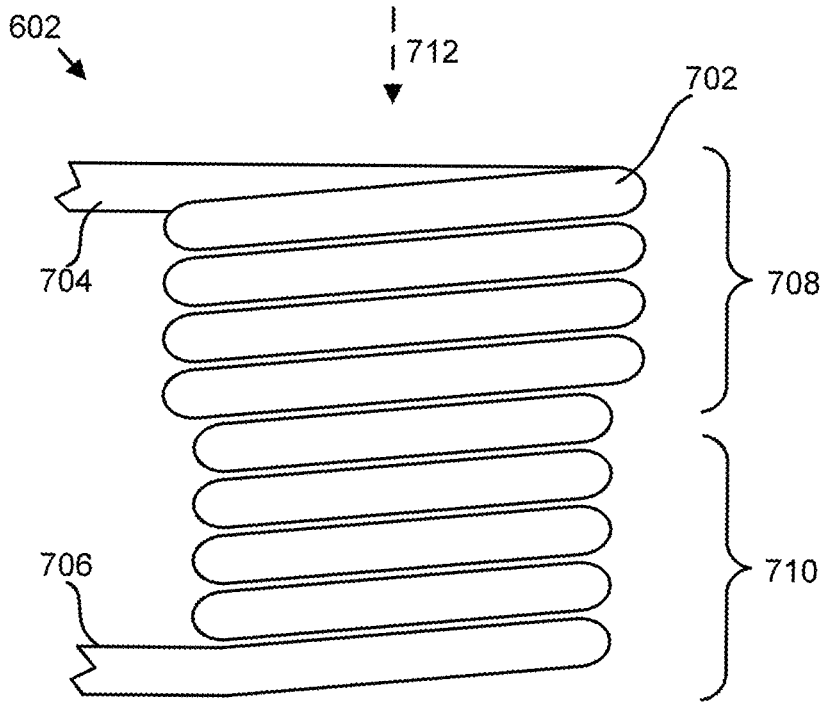
FIGS. 7A and 7B illustrate top and side views of one embodiment of an inductive coil in accordance with the present invention.
Figure 7B:
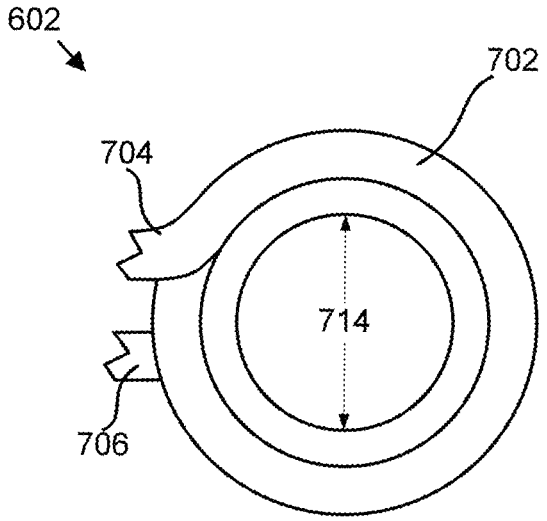

FIGS. 7A and 7B illustrate one embodiment of an inductive coil 602 for heating a cartridge case. FIG. 7A is a side view of one embodiment of an inductive coil 602. The inductive coil 602 may be formed of a tubing 702 having ends 704 and 706.

In one embodiment, the tubing 702 is formed of copper or some other conductive metal. The conductive tubing 702 may be wound into a helical shape having a large diameter portion 708 and a small diameter portion 710. FIG. 7B is a top view of the inductive coil 602 of FIG. 7A from the direction indicated by line 712. FIG. 7B illustrates a smallest internal diameter 714. According to one embodiment, the smallest internal diameter 714 may be large enough for the largest portion of a cartridge case to pass through.

In one embodiment, the inductive coil 602 may be formed by winding, bending, and/or shaping tubing 702 into a helical shape. In one embodiment, a mandrel may be used as a guide for shaping the tubing 702.

According to one embodiment, the ends 704, 706 of the coil may be connected to a power source. The power source may be used to provide an electrical signal through the tubing 702 in order to heat an object within the inductive coil's 602 interior diameter. In one embodiment, an electrical signal through the tubing 702 may induce a large amount of heat in the tubing 702 of the inductive coil 602 itself. In one embodiment, a coolant may be circulated through the tubing to keep the coil 602 from getting excessively heated or damaged. The coolant may include any coolant known in the art, including water or an oil.

A number of factors may influence how an object within the inductive coil 602 is heated. According to one embodiment, variations in the signal may affect how quickly an item will be heated and/or how hot the item can ultimately get. One factor may include the amplitude of an electrical signal. For example, an electrical signal with a higher power will create a stronger magnetic field and result in greater heat generation. Another factor may include a wave shape of the electric signal. For example, a square wave may induce a higher intensity magnetic field than a sinusoidal or triangular wave. Another factor may include a frequency of the electric signal. Higher frequency signals may cause a more rapidly cycling magnetic field which may induce greater heat creation within a given time.

Yet another factor may be the overall length of the signal. The longer a signal is applied to the coil the greater the amount of time during which heat is generated in a cartridge case in the coil. This may lead to a higher temperature than if the signal length was shorter. Additionally, the overall length of the signal may also impact how uniform an object or cartridge case is heated. For example, a longer signal time may allow for heat to more evenly dissipate throughout a cartridge while a shorter signal time may keep heat localized. In some embodiments, shorter signal times may be desirable to obtain a hardness gradient within the cartridge case. In one embodiment, the overall length of the signal is very short. In one embodiment, the length of the signal is less than two seconds. In one embodiment, the length of the signal is less than one second. In one embodiment, the length of the signal is between about 500 and 800 milliseconds. In one embodiment, length of the signal is about 600 milliseconds.

In one embodiment, variations in geometry of both the inductive coil 602 and a cartridge case may also affect how quickly a cartridge case is heated or how hot the cartridge case can get. Variations in geometry of both the inductive coil 602 and a cartridge case may also affect how uniformly or non-uniformly a cartridge case within the coil is heated.

In one embodiment, a diameter of the tubing 702 that is used to form the coil 602 may affect how much current the coil 602 can handle as well as how smooth an induced magnetic field may be. For example, tubing 702 having a larger diameter may have a lower impedance and may allow for a higher current without excessive losses of heat within the coil 602 itself. On the other hand, tubing 702 having smaller diameters may create a smoother or more uniform magnetic field. A smoother or more uniform magnetic field may allow for a more controlled and predictable temperature profile in a cartridge case.

In one embodiment, a diameter of an inductive coil 602 may affect how a cartridge case is heated. For example, a smaller diameter may induce a more intense magnetic field thorough the coil given the same amount of current. This more intense magnetic field my then induce greater currents within a cartridge casing and lead to greater heat generation. Larger diameters may have a less intense magnetic field. In one embodiment, an inductive coil 602 may be a stepped coil, like the coil 602 of FIGS. 7A and 7B. That is the inductive coil 602 has a plurality of diameters within the same coil 602. In one embodiment, one portion of the coil (such as the smaller diameter 710) will generate a larger amount of heat than another portion (such as the larger diameter 708), assuming an cartridge case with uniform diameter. In one embodiment, an object having a nonuniform diameter within a stepped coil may have approximately equal amounts of heat generated at all locations.

Additional factors that may affect how a cartridge case is heated may include the material of the cartridge case and the structure of the cartridge case. According to one embodiment, portions of a cartridge case having greater mass may require greater amounts of heat to be generated to create the same temperature as in a less massive portion. For example, in the closed end 206 of the cartridge case tube 202 of FIG. 2 has more mass than the open end 208. In one embodiment, the closed end 206 may be oriented such that it is within the inductive coil 602 on the smaller diameter 710 end of the coil.

Figure 8A:
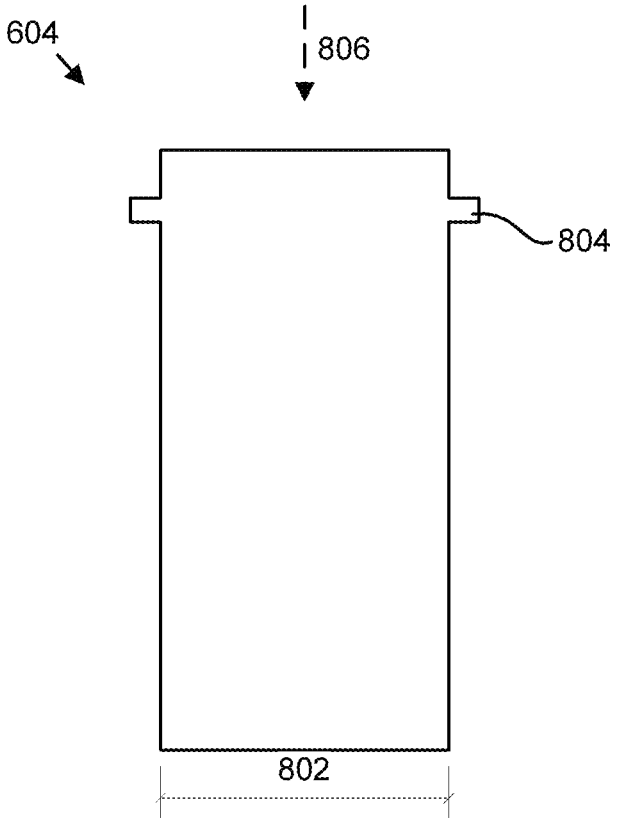
FIGS. 8A and 8B illustrate top and side views of one embodiment of a coil insert in accordance with the present invention.
Figure 8B:
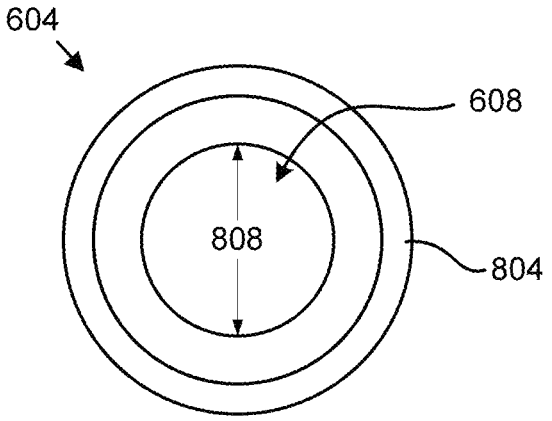

Returning to FIG. 6 an annealing module 404 may also include a coil insert 604. In one embodiment, the coil insert 604 may be inserted into the inductive coil 602. FIGS. 8A and 8B illustrate one embodiment of a coil insert 604. FIG. 8A is a side view of coil insert 604 depicting an outside diameter 802 and a lip 804. FIG. 8B illustrates a top view of the coil insert 604 along the line 806 and illustrates an inside diameter 808. In one embodiment, the coil insert 604 is configured for insertion into the inductive coil 602 of FIGS. 7A and 7B. For example, the outside diameter 802 may be small enough to allow the coil insert 604 to fit within the smallest inside diameter 714 of the inductive coil 602. In one embodiment, the lip 804 may rest on a portion of an inductive coil 602 to maintain its position with relation to the coil.

In one embodiment, the inside diameter 808 of the coil insert 604 may be large enough to allow a cartridge case to fit within the coil insert 604. In one embodiment, the inside diameter 808 defines an annealing chamber 608 such that a cartridge case may pass through the inside diameter 808 of the coil insert 604. In one embodiment, the inside diameter 808 substantially matches an outside diameter of a cartridge case. For example, the inside diameter 808 may be large enough for a cartridge case to slide through the coil insert 604 but may also be small enough for each successive cartridge case to be supported in substantially the same position.

In one embodiment, the coil insert 604 is formed of a nonconductive material and/or a nonmagnetic material. In one embodiment, the coil insert 604 is formed of a ceramic. For a ceramic free of conductive or magnetic particles may be used. In one embodiment, the coil insert 604 may be formed of any nonconductive and non magnetic material. In one embodiment, a coil insert 604 formed of a nonconductive and nonmagnetic material may allow for magnetic waves induced by the inductive coil 602 to pass through the coil insert 604 with little or no interaction with the material of the coil insert.

The coil insert 403 may keep a cartridge casing from contacting the inductive coil 602. For example, without a coil insert 604 there may be risk of a cartridge casing contacting portions of the inductive coil 602 and causing a short which would reduce the magnetic field and/or reduce the amount of uniform heating that can be created through an induced magnetic field. Additionally, collision between a cartridge case and the coil 602 may result in damage to the coil. This may especially be the case in situations where larger ammunition cases are being formed. In one embodiment, the coil insert 403 decreases the likelihood of contact between the coil 602 and a cartridge case.

Figure 9:
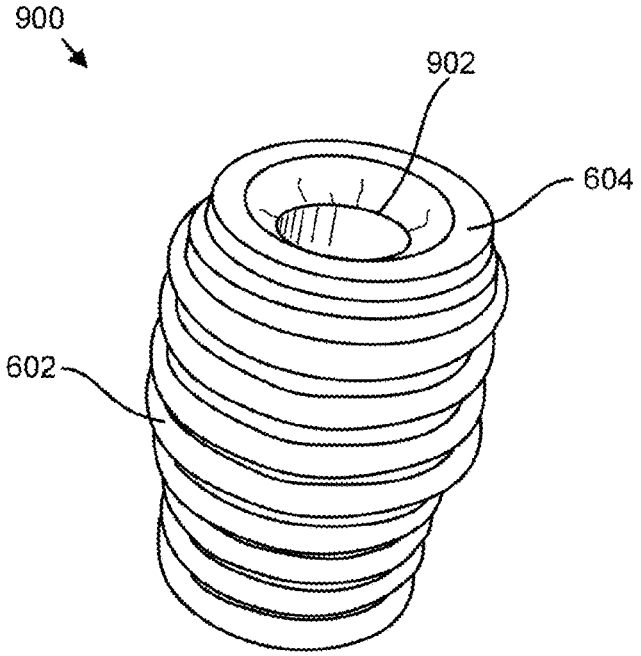
FIG. 9 illustrate one embodiment of a coil and insert assembly in accordance with the present invention.

FIG. 9 illustrates a coil and insert assembly 900 that includes the inductive coil 602 with an inserted coil insert 604. A cartridge case 902 is shown within the coil insert 604 and is only partially visible.

Returning to FIG. 6, an annealing module 404 may include a module case 606. In one embodiment, a module case 606 may form a semi rigid case for housing the inductive coil 602. In one embodiment, the module case 606 may protect the coil 602 from contact with other objects or with individuals. For example, due to high voltages that may flow through the inductive coil 602 it may reduce risk of electrical short or shock which may cause damage to other devices or to individuals.

Additionally, the module case 606 may provide a rigid structure that helps maintain an inductive coil 602 in substantially the same shape and/or geometry. As discussed above, the geometry of the inductive coil 602 can influence how a cartridge casing is heated. If an inductive coil must support its own weight it may sag over time and heating of cartridge casings may then also vary over time. A rigid or semi rigid module case 606 may reduce an amount of deformation of the inductive coil 602 and thus maintain a more uniform heating of cartridge casings over time.

Figure 10:
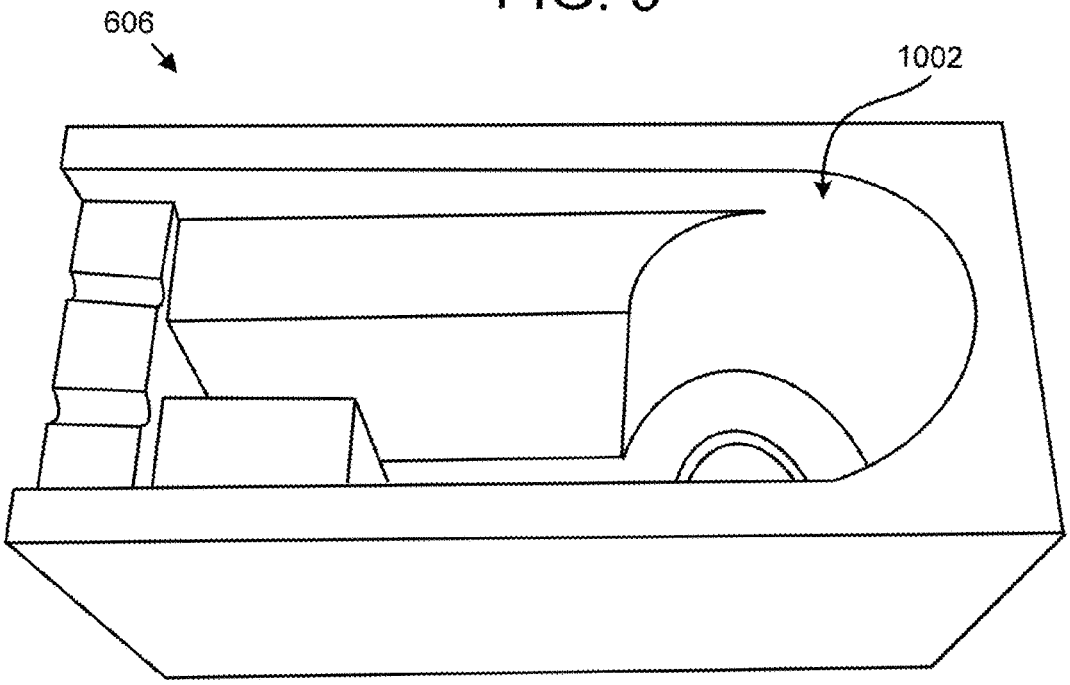
FIG. 10 illustrates a perspective view of one embodiment of an annealing module case in accordance with the present invention.

FIG. 10 illustrates one embodiment of a module case 606. The module case 606 includes a coil cavity 1002 for receiving an inductive coil 602. For example, the coil and insert assembly 900 of FIG. 9 may be inserted into the coil cavity 1002. The geometry of the module case 606 is exemplary only.

In one embodiment, the module case 606 may be formed of a nonconductive and/or nonmagnetic material. In one embodiment, the module case 606 may be formed of a plastic, ceramic, plaster, rubber, Teflon, nylon or any other material. In one embodiment ends 704, 706 may be threaded out of the module case 606 and connected to a power supply and/or pump as previously discussed.

Returning again to FIG. 6 an annealing module 404 may include an annealing chamber 608. In one embodiment, the annealing chamber 608 may be where cartridge cases are placed when annealed. For example, a cartridge case may be placed in an annealing chamber 608 and then an electrical signal may be passed through an inductive coil 602 to heat the cartridge case.

In one embodiment, an annealing chamber 608 is defined by one or more of the inductive coil 602, the coil insert 604, and the module case 606. In one embodiment, the annealing chamber 608 is encircled by one or more of the inductive coil 602, the coil insert 604, and the module case 606. In one embodiment, the bounds of the annealing chamber 608 are defined by the inside diameter 808 of the coil insert 604. For example, the cartridge case 902 of FIG. 9 within the coil and insert assembly 900 is shown within one embodiment of a through hole chamber.

In one embodiment, the annealing chamber 608 may be of a size to closely match a geometry of a cartridge case. For example, the annealing chamber 608 may be shaped to accommodate only a single cartridge case at a time. This may allow each cartridge case to be heated in a uniform matter. For example, with an annealing chamber 608 that closely corresponds to the geometry of a cartridge case each cartridge case may be in substantially same position in relation to a heating coil. This may reduce the amount of variation between heating of cartridge cases.

Additionally, heating a single coil at a time may allow for closed loop feedback for heating cartridge cases. For example, while a cartridge case is being heated the a temperature of a cartridge case may be measured. The cartridge case may be heated until a desired temperature level is reached.

Even without closed loop control, by heating a single cartridge case at a time and measuring its temperature slight changes and variations in how cartridge cases are being heated can be noticed. For example, if there is a trend that cartridge cases temperatures are slowly dropping in temperature one or more factors, such as a signal duration or wave shape, can be varied to obtain a desired temperature. Thus, variations in temperatures of cartridge cases can be noticed and remedied before any cartridge case fails. Heating and testing of a single cartridge case may allow for the accommodation of ambient temperatures changes or changes in cartridge cases. Heating and testing of a single cartridge case may significantly limit the amount of wasted material or time that may when cartridge cases begin to fail being properly heated and/or formed.

In one embodiment, an annealing chamber 608 may be a through hole chamber. For example, the chamber 608 may allow a cartridge case to be placed within an annealing chamber 608 through one opening and released from the annealing chamber 608 through another opening. In one embodiment, an annealing chamber 608 may include a vertically oriented with an opening at the top and an opening at the bottom. In one embodiment, a feeder module 402 may feed a cartridge case into the annealing chamber 608 from above that allows the cartridge case to move downward into the chamber. The cartridge case may be retained within the chamber during and anneal and then released to move downward out of the chamber. In one embodiment, allowing a cartridge chamber to be released downward out of the chamber instead of upward from the direction in which it was fed may reduce the amount of time required to remove the cartridge case and feed a next cartridge case into the chamber. In one embodiment, a vertically oriented through-hole chamber may allow for greater simplicity in an annealing step and reduce the chance of errors or failure. In one embodiment, gravity may facilitate movement of a cartridge case through the annealing module.

The annealing module may include a release mechanism 610. In one embodiment, the release mechanism 610 may allow a cartridge case to be released from the annealing module 404. In one embodiment, the release mechanism may simply allow a cartridge casing to drop out a bottom of an annealing module 404 due to gravity. In one embodiment, some assistance may be provided by the release mechanism 610 to provide a force to move the cartridge case from the chamber. For example, the release mechanism 610 may provide forced air or any other mechanism that applies a force to the cartridge case to move it out of the annealing module 404.

Figure 11:
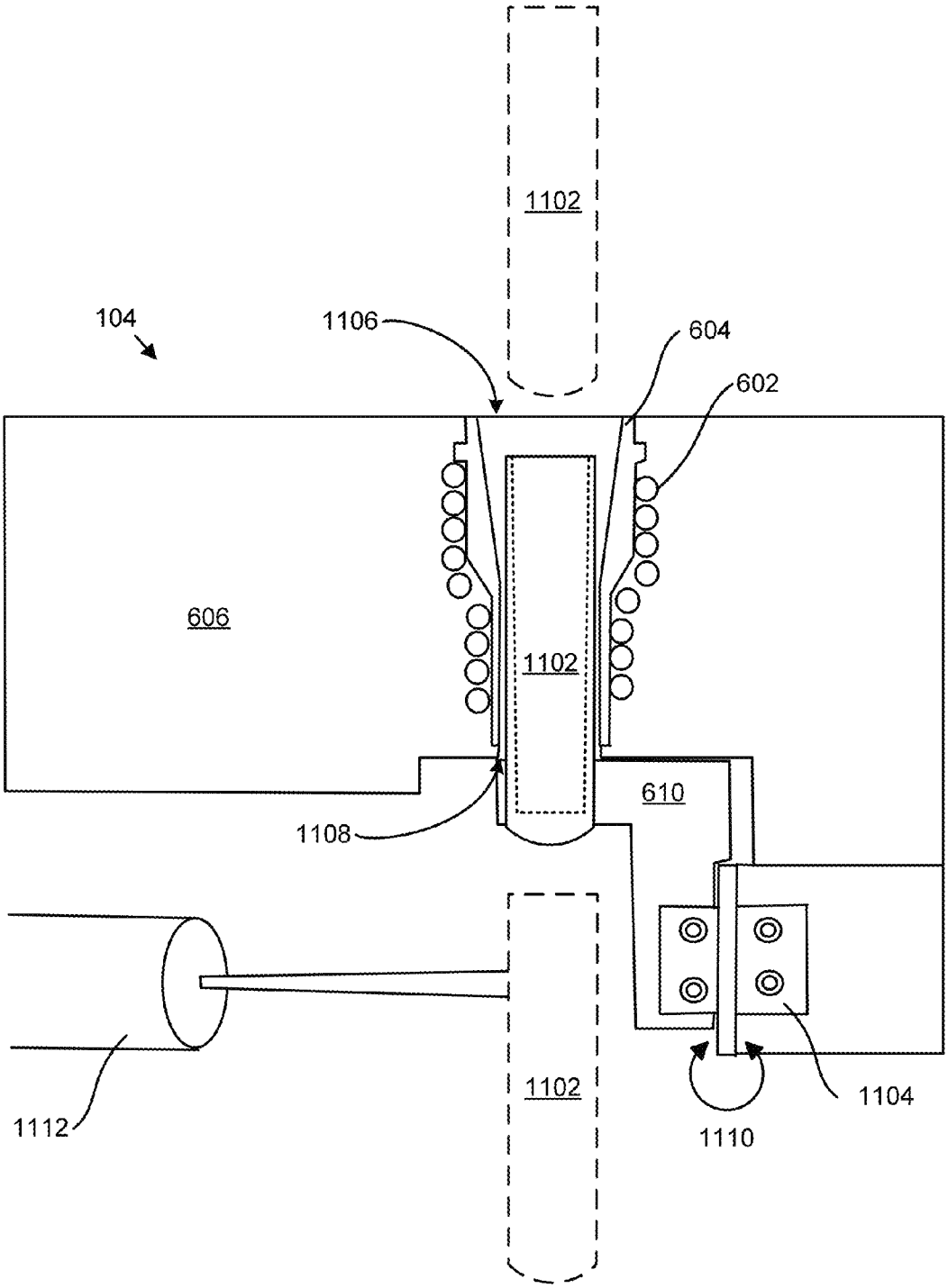
FIG. 11 is a cross-sectional side view of an annealing module illustrating exemplary movement of a cartridge case through the annealing module in accordance with the present invention.

FIG. 11 is a cross sectional side view of an annealing module 404 illustrating exemplary movement of a cartridge case 1102 through the annealing module 404. FIG. 11 depicts an annealing module 404 and a cartridge case 1102 at different positions. The annealing module 404 is depicted including an inductive coil 602, a coil insert 604, and a module case 606, each of which may include any of the variations previously discussed. The annealing module 404 is also depicted including a release mechanism 610.

In the depicted embodiment, the cartridge case 1102 is shown at three positions in relation to the annealing module 404. The cartridge case 1102, at one position, is above the annealing module 404. According to one embodiment, the cartridge case 1102 is fed from this position above the annealing module 404 into the coil insert 604 through a first opening 1106. In one embodiment, the cartridge case 1102 is fed by a feeder module 402, which is not shown. In one embodiment, the cartridge case 1102 is fed by allowing gravity to pull the cartridge case 1102 into the annealing module 404. In one embodiment, forced air may be used to move the cartridge case 1102 into the annealing module 404.

The cartridge case 1102 is also shown within the annealing module 404. In one embodiment, the cartridge case 1102 may remain within the annealing module 404 for a period of time to heat the cartridge case. In one embodiment, the cartridge case 1102 remains within the annealing module 1102 for less than three seconds. In one embodiment, the cartridge case 1102 may remain within the annealing module 1102 for less than two seconds. According to one embodiment, a position of the cartridge case 1102 in relation to the inductive coil 602 may be adjusted. For example, a height of the cartridge case 1102 in relation to the inductive coil 602 may be adjusted. For example, the release mechanism 610 may be moved up or down in relation to the inductive coil 602 to adjust the height of the cartridge case 1102 in relation to the coil 602.

The position of the cartridge case 1102 within the coil 602 illustrates the geometry of the coil 602 in relation to the mass of the cartridge case 1102. In one embodiment, the cartridge case 1102 is illustrated in a position in relation to the coil 602 in which the cartridge case 1102 would be heated. For example, the lower portion of the inductive coil 602 has a smaller diameter than the upper portion. According to one embodiment, more heat will be generated in the lower or middle portion of the cartridge case 1102. This may be desirable because there is greater mass in the lower portion, or capped end, of the cartridge case 1102, as illustrated. In one embodiment, the cartridge case 1102 may be heated to a uniform temperature. In one embodiment, the cartridge case 1102 is heated to a gradient of temperatures along its length. In one embodiment, the heat to which a portion of the cartridge case 1102 is heated controls a hardness at that portion of the cartridge case 1102.

In one embodiment following a heating of the cartridge case, the release mechanism 610 may allow the cartridge case to drop from the annealing module 404 to a third position below the annealing module 404. In one embodiment, the release mechanism 610 may include a hinge 1104 which allows the release mechanism 610 to rotate as indicated by arrows 1110 to allow the cartridge case 1102 to drop from the annealing module 404. In one embodiment, the cartridge case is released through a second opening 1108. In one embodiment, a transfer module 408 (not shown) may receive the cartridge case.

In one embodiment, a non-contact laser thermometer 1112 may test the temperature at one or more points on the cartridge case 1102. Testing the temperature may indicate whether the annealing module 404 is functioning properly and/or if any adjustments need to be made. For example, one or more factors that affect how a cartridge case 1102 is heated may be adjusted for one or more later cartridges. These factors include geometry of the coil, attributes of the electrical signal passed through the coil, etc.

Figure 12:
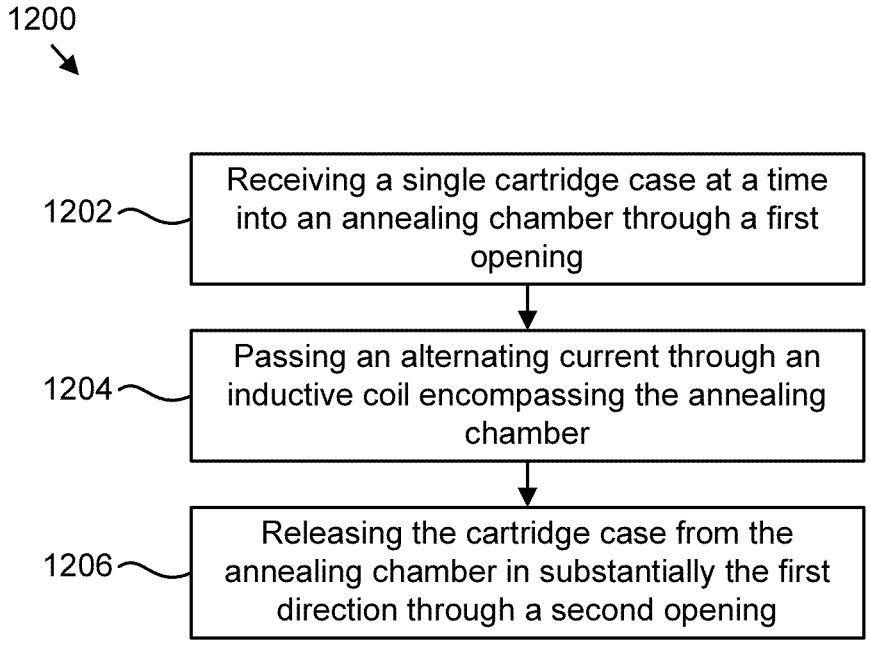
FIG. 12 is schematic flow chart diagram illustrating a method for heating a cartridge case in accordance with the present invention.

FIG. 12 is schematic flow chart diagram illustrating a method 1200 for heating a cartridge case. In one embodiment, the method 1200 is performed by an annealing module 404. In one embodiment, the method 1200 may be used to soften a cartridge case, harden a cartridge case, reduce stress within the material of a cartridge case, or any other purpose. In one embodiment, the method 1200 is used prior to a cartridge case forming step.

The method 1200 may include receiving 1202 a cartridge case into an annealing chamber. In one embodiment, a single cartridge case is received 1202. In one embodiment, the cartridge case is received into the annealing chamber through a first opening. In one embodiment, the cartridge case may be received from a feeder module 402. In one embodiment, the cartridge case is fed into the annealing chamber in a downward vertical direction. In one embodiment, the cartridge case is received in a controlled orientation.

The method 1200 may include passing 1204 an alternating current through an inductive coil. In one embodiment, the inductive coil encompasses the annealing chamber. The inductive coil may encompass the sides of the annealing chamber without enclosing the first opening or a second opening of the annealing chamber. In one embodiment, the inductive coil may include a stepped coil. For example, the inductive coil may include a first diameter portion and a second diameter portion that have different diameters.

Passing 1204 the alternating current through the inductive coil may include passing a current having a variety of signal shapes. In one embodiment, the alternating current includes one or more of a square, a triangular, or a sinusoidal wave shape. In one embodiment, the alternating current is passed 1204 through the inductive coil for less than two seconds. In one embodiment, the alternating current is passed 1204 through the inductive coil for less than 800 milliseconds or 600 milliseconds. In one embodiment, the alternating current is passed 1204 through the inductive coil while the cartridge case is held substantially stable in relation to the inductive coil.

The method 1200 may include releasing 1206 the cartridge case from the annealing chamber. In one embodiment, the cartridge case is released 1206 in substantially the same direction in which the cartridge case was received 1202. In one embodiment, the cartridge case is received 1202 and released 1206 in a substantially downward vertical direction. In one embodiment, the cartridge case is released 1206 through a second opening that is different than the opening through which the cartridge case was received. In one embodiment, the cartridge case is released and gravity is allowed to pull the cartridge case from the annealing chamber in a downward direction. In one embodiment, a transfer module 408 receives the cartridge case in a controlled orientation when the cartridge case is released 1206.

Figure 13:
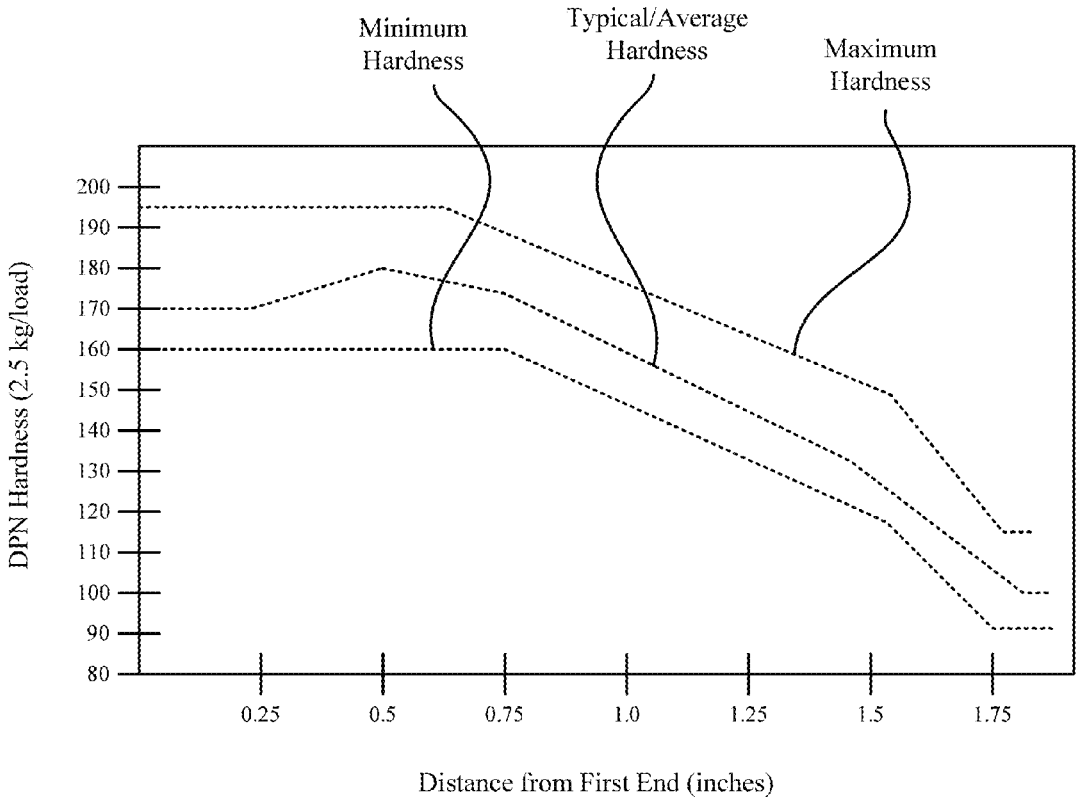
FIG. 13 is a hardness gradient chart of one embodiment of a cartridge case in accordance with the present disclosure.

FIG. 13 is a hardness gradient chart of a cartridge case in accordance with the present disclosure. FIG. 13 depicts three hardness gradient curves labeled "Minimum Hardness", "Typical/Average Hardness", and "Maximum Hardness". As described above, the annealing module may be used to generate at least two points along the length of the cartridge case that have different hardness ratings. The different degrees of hardness along the length of the cartridge case may prepare the case for subsequent processing steps or may provide the requisite hardness for a certain application. As depicted and according to one embodiment, the annealing module is capable of creating cartridge cases that generally fall within a certain hardness range.

According to one embodiment, a cartridge manufacturing system 100 may perform one or more steps or processes, such as the steps and processes discussed above, to form at least a partially finished cartridge case. In one embodiment, one or more forming, annealing, and/or other processes may be performed to create a cartridge case with the specifications shown in FIG. 13. One of skill in the art will recognize that cartridge cases of various specifications may be annealed, formed, or otherwise modified without departing from the scope of the present disclosure.

Figure 14:
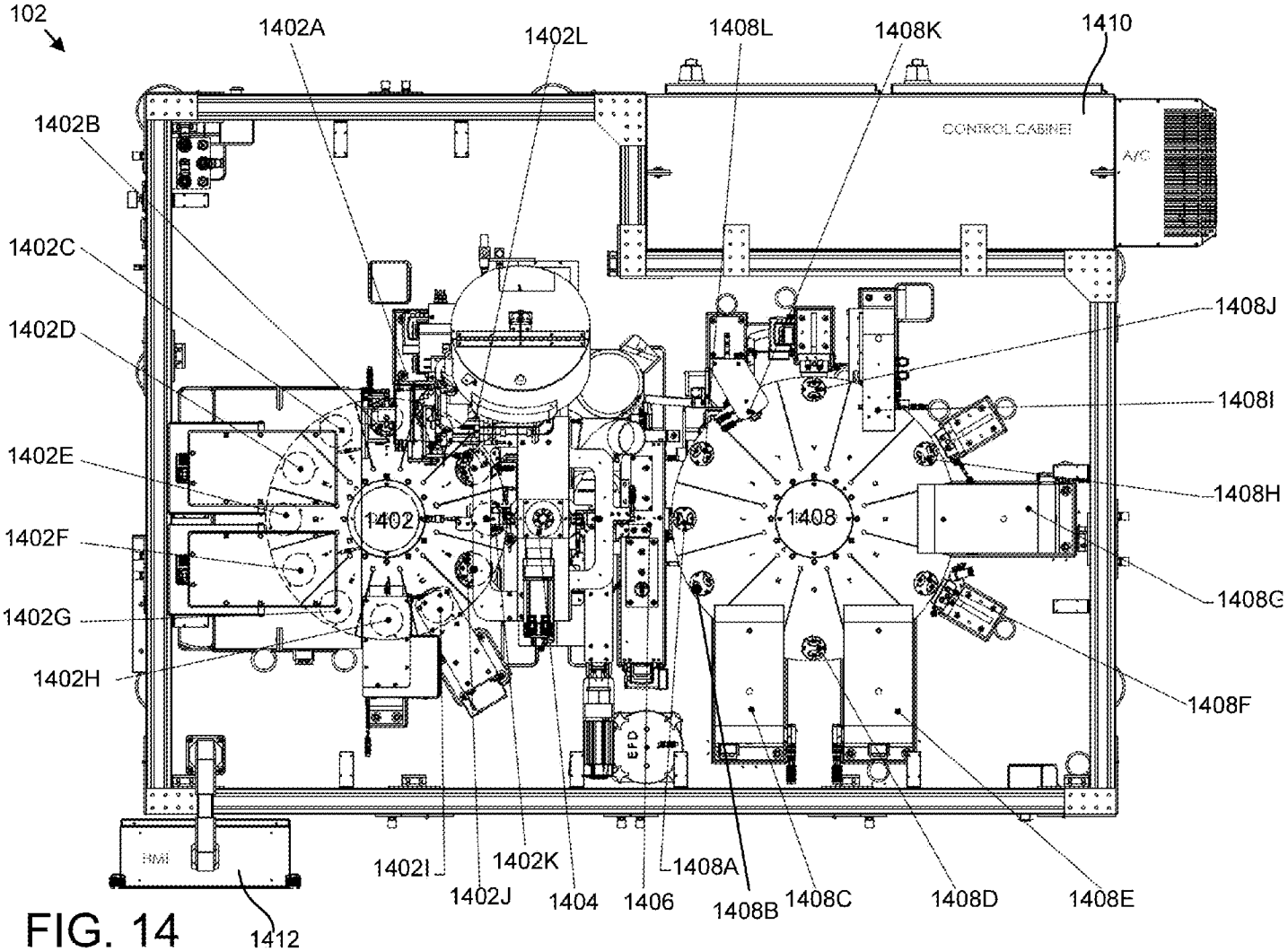
FIG. 14 illustrate a plan view case forming system in accordance with the present invention.

Turning now to FIG. 14 exemplary operation and components of the head forming module 410, the extractor groove module 412, and the taper module 414 will now be discussed. FIG. 14 is a plan view of one embodiment of a case forming system 102. The case forming system 102 includes a first dial table 1402, a first chuck dial 1404, a second chuck dial 1406, a second dial table 1408, a control cabinet 1410, and a human-machine interface 1412.

In one embodiment, the case forming system 102 may be configured to step a cartridge case through a number of stages for forming a cartridge case. In one embodiment, the stages are closely spaced such that the forming system 102 does not take up much space. In one embodiment, distance between a stage and a subsequent stage may be less than 12 feet. In one embodiment, distance between a stage and a subsequent stage may be less than 6 feet. In one embodiment, distance between a stage and subsequent stage may be less than 3 feet. In one embodiment, distance between a stage and subsequent stage may be less than 1 foot.

The first dial table 1402 may include a plurality of stages 1402A-1402L for forming a head of a cartridge case. The chuck dials 1404, 1406 may include a plurality of stages for transferring a cartridge case from the first dial table 1042 to a chuck for forming a groove and transferring a cartridge case to the second dial table 1408. The second dial table 1408 may include a plurality of stages 1408A-1408L for forming a taper on a neck of a cartridge case. The control cabinet 1410 may include computing devices, communication devices, software, and/or circuitry for controlling the forming system 102. The human-machine interface 1412 may provide input and/or output devices for a human to interface with the case forming system 102.

The first dial table 1402 may include a plurality of stages 1402A-1402L where one or more forming steps are formed on a cartridge case. In one embodiment, the first dial table 1402 and the machinery for implementing the forming steps at one or more of the stages 1402A-1402L may be comprised in a head forming module 410. In one embodiment, the first dial table 1402 includes twelve stages 1402A-1402L and rotates one twelfth of a rotation at a stage interval. At one or more of the stages 1402A-1402L one or more steps may be performed on a cartridge case. For example, a cartridge case may be loaded on at one stage and may rotate with the table through one or more of the remaining stages where one or more forming steps are performed. Exemplary steps and processes that occur at each stage 1402A-1402L will now be discussed.

In one embodiment, one or more of the stages 1402A-1402L may be polled to determine if steps at the stages have been completed. In one embodiment, the first dial table 1402 may not rotate until steps at each of the stages 1402A-1402L have been completed. In one embodiment, the time between rotations may vary depending on when steps at each of the stages are completed.

In one embodiment, a head forming module 410 may include an onload stage 1402A. The onload stage 1402A may include transferring a cartridge case that has been annealed by the annealing module 404 to the first dial table 1402. In one embodiment, the cartridge case may be transferred by a transfer mechanism from an annealing module 404 to the first dial table 1402. In one embodiment, the cartridge case may be transferred from a cooling rack to the first dial table 1402.

In one embodiment, the onload stage 1402 may involve placing a cartridge case open end downward on a stem. The stem may include a rod that extends from a die nest and fits within a cartridge case. The die nest may include one or more structures for holding and supporting the cartridge case for one or more forming steps. For example, a die nest may include a shape for holding a cartridge case during a press, stamp, and/or punch step. In one embodiment, one or more arms or other devices may be used to place the cartridge case on the stem. In one embodiment, the cartridge case will remain on the stem during one or more forming steps of a head forming module 410.

In one embodiment, after a cartridge case is loaded onto the first dial table 1402 during the onload stage 1402A, the dial table 1402 may rotate one-twelfth of a rotation such that the cartridge case loaded during the onload stage 1402A may then be located at a subsequent stage. In this manner a plurality of cartridge cases may be loaded and simultaneously processed at a plurality of stages by the cartridge forming system 102.

In one embodiment, a head forming module 410 may include a seating stage 1402B. In one embodiment, the seating stage 1402B may include seating the cartridge case within the die nest. In one embodiment, the stem may retract and allow the cartridge case to be seated in the die nest. The cartridge case may be pressed into the die nest while still maintained on the stem. The seating stage 1402B may situate the cartridge case in the die nest in preparation for one or steps where the shape of the head of the cartridge case is modified by a press. For example, a press may provide force between the die nest and a die tool to alter a shape of the cartridge case.

In one embodiment, a head forming module 410 may include an empty stage 1402C. For example, empty stage 1402C may not include any forming steps but may include an empty slot of the dial table where no action is performed on the cartridge case. In one embodiment, this may be due to the size of devices, presses, and mechanism on neighboring stages that limit an ability to perform a step at the empty stage 1402C.

In one embodiment, a head forming module 410 may include a pocketing stage 1402D. In one embodiment, the pocketing stage 1402D may include a press that performs a pocketing step on the head of a cartridge case. For example, the pocketing stage 1402D may include a pocketing tool which forms at least partially forms a pocket on a closed end of a cartridge case.

In one embodiment, the pocketing stage 1402D may not be included. For example, a single forming stage, such as the heading stage 1402F, may be sufficient to obtain a desired head shape. In one embodiment, the pocketing stage 1402D may be included to provide additional cold working of the head of the cartridge case. For example, multiple cold forming steps (such as a pocket forming and heading step) may impart additional hardness to the cartridge case. For example, some materials, such as brass are hardened by cold working the material. In one embodiment, one or more cold working steps may help obtain a desired head hardness.

A head forming module 410 may include an additional empty stage 1402E. In one embodiment, the empty stage 1402E may be necessary due to large stamp presses at adjacent stages.

In one embodiment, a head forming module 410 may include a heading stage 1402D. The heading stage 1402F may include an additional press operation which shapes the head of a cartridge casing. In one embodiment, the heading stage 1402F may form one or more characters or symbols on the head of the cartridge for identification of the type of cartridge case. For example, a caliber, name, or other information may be stamped on the head of the cartridge case.

Figure 15:
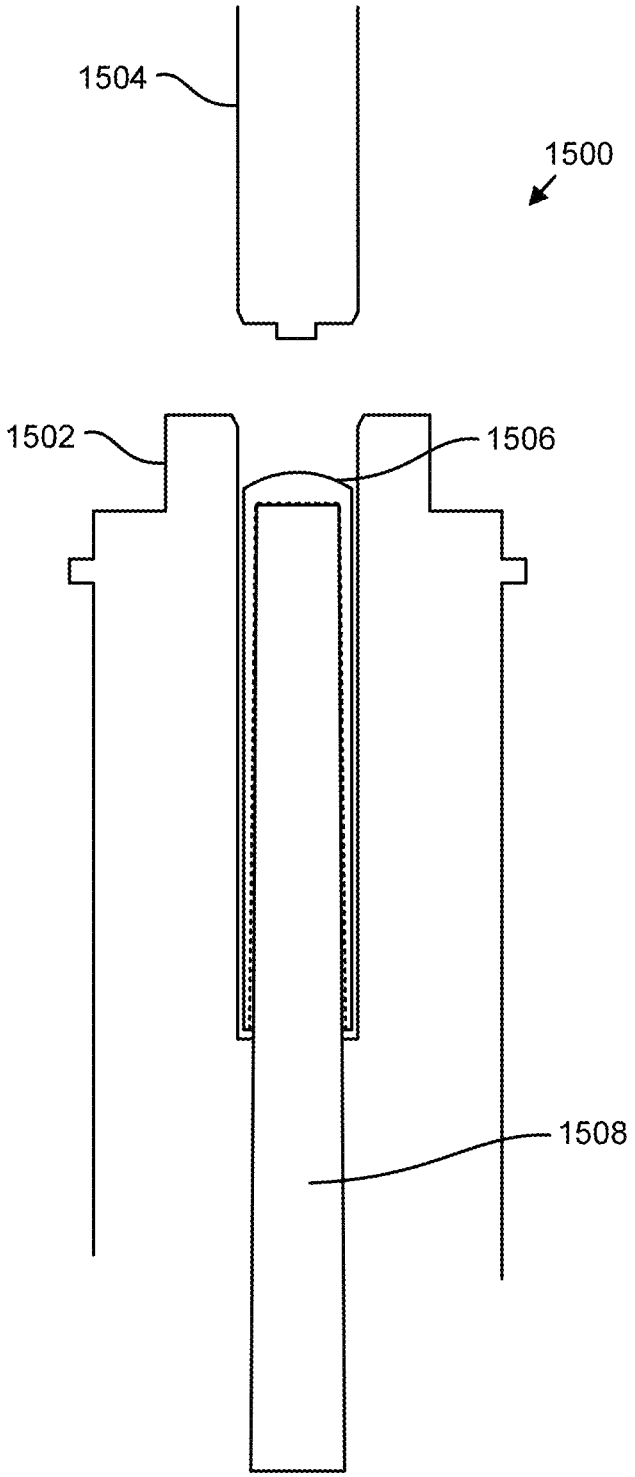
FIG. 15 illustrates a cross-sectional side view of a pocketing tooling of a pocketing stage in accordance with the present invention.

FIG. 15 illustrates a cross-sectional side view of one embodiment of heading tooling 1500 for a heading stage 1402F. The heading tooling 1500 includes a die nest 1502 and a heading tool 1504. A cartridge case 1506 is illustrated within the die nest 1502 and mounted on a stem 1508.

In one embodiment, the die nest 1502 and stem 1508 rotate with the cartridge case 1506 through one or more stages. For example, the die nest 1502 and stem 1508 may be the same die nest and stem at the onload stage 1402A and which has rotated with the dial table 1402 through the intervening stages to the heading stage 1402F. In one embodiment, the stem 1508 is actuated such that it can extend from the die nest 1502 to receive the cartridge case 1506 and retract so that the stem 1508 and cartridge case 1506 may be seated within the die nest 1502.

The heading tool 1504 includes a geometry for forming the head of the cartridge case 1506 into a desired shape. In one embodiment, the heading tool 1504 includes a geometry for forming a pocket in the head of the cartridge case 1506. In one embodiment, the heading tool 1504 is allowed to float in one or more directions. For example, the heading tool 1504 may be fixed in only a vertical direction but allowed to float or rotate freely in horizontal or axial directions. In one embodiment, a floating heading tool 1504 may allow for self alignment of the heading tool 1504 with the die nest 1502. For example as the heading tool 1504 is moved toward the die nest 1502 a floating heading tool 1504 may be allowed to float in one or more directions to align with the die nest 1502.

A floating heading tool 1504, or a floating die at any stage within the forming system 102, may allow for reduced set up requirements of a press. For example, a press utilizing a floating die may need to be adjusted such that a tool and a die nest are only approximately aligned. The floating die may then be allowed to self align as it brought against a die nest. In one embodiment, extremely high tolerances can be met with very minimal effort in die tool and die nest alignment. Additionally, maintenance required for continued operation may also be reduced. For example, as a press heats up or is used over time the press may change in shape. A floating die tool may allow for accommodation of such changes without requiring repeated alignment and/or calibration over time. Even if repeated alignment and calibration is needed it may not be needed as often and may be much easier to perform.

In one embodiment, the die nest 1502 may be monitored by a force sensor. For example, the die nest 1502 may be supported by a load cell. In one embodiment use of a force sensor supporting the die nest 1502 may allow for real time tracking of the amount of force created between the heading tool 1504 and the die nest 1502. For example, the force created during a heading step may be recorded and/or tracked to determine whether an expected amount of force was created. If too little or too much force is created, an operator or control system may be notified. Additionally, if the amount of force is slowly changing over time, this information may be used to slightly adjust a press to create sufficient amounts of force before a cartridge case 1506 is improperly form and/or must be discarded as scrap.

In one embodiment, the heading tool 1504 and/or the die nest 1502 may be actuated by a servo motor. In one embodiment, a servo motor allows for accurate and controlled actuation of the heading tool 1502 and the die nest 1502 in relation to each other. This may allow a press and/or forming system 102 to determine the position reached between a heading tool 1504 and die nest 1502. In one embodiment, the location determined by the servo motor may help in determining whether a cartridge case 1502 was properly formed during a step. For example, if the servo motor has not been able to move the heading tool 1504 as far as expected, the forming system 102 may determine that an error occurred and should be investigated. This may allow for quick and precise determinations of error before large amounts of cartridge cases are improperly formed.

In one embodiment, a load cell used in combination with a servo motor may provide significant utility. For example, by being able to track both the relative position between the die nest 1502 and heading tool 1504 as well as the force created, it may be easily determined if errors are occurring as well as the nature of the errors.

Figure 16A:
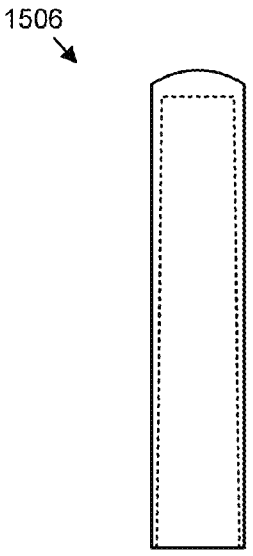
FIG. 16A-16E illustrate cross-sectional side views of a cartridge case at different stages within a cartridge forming process in accordance with the present invention.
Figure 16B:
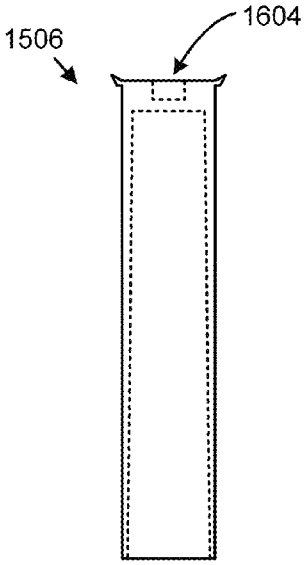

FIGS. 16A and 16B illustrate an exemplary change in shape of the cartridge case 1506 between an onload stage 1402A and through the heading stage 1402F. FIG. 16A illustrate the cartridge case 1506 at onload and FIG. 16B illustrates the cartridge case 1506 after pocketing and/or heading with a pocket 1604 formed in the head of the cartridge case 1506.

A head forming module 410 may include a pocket inspection stage 1402G. In one embodiment, the pocket inspection stage 1402G may include a camera inspection of a pocket formed by one or more previous stages, for example, the pocket forming and heading stages 1402D and 1402F. In one embodiment, the pocket inspection stage 1402 may inspect the pocket to determine if it has been properly formed. For example, the diameter of the pocket may be inspected for proper size. In one embodiment, characters or other information stamped on the head may also be inspected. In one embodiment, if a character, symbol or other information is missing or disfigured the forming system 102 may determine that a tool or other component has broken. For example, if a letter is missing the forming system 102 may notify an operator to inspect whether a letter has broken off of a stamping tool.

Figure 16C:
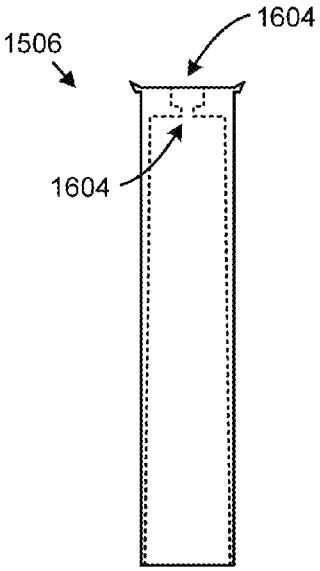

A head forming module 410 may include a vent piercing stage 1402H. In one embodiment, the vent piercing stage 1402H may include piercing a vent hole through a pocket into an interior of the cartridge case. FIGS. 16B and 16C illustrate an exemplary change in the cartridge case 1506 during the piercing stage 1402H. FIG. 16B illustrates one embodiment of the cartridge case 1506 before piercing and FIG. 16C illustrates the cartridge case 1506 after piercing with vent hole 1604 extending between the pocket 1604 and the interior of the cartridge case 1506.

A head forming module 410 may include a vent inspection stage 1402I. In one embodiment, the vent inspection stage 1402I may test whether a vent was completely formed. For example, the vent inspection stage 1402 may inspect to determine if the material that was in the vent has been removed. In one embodiment, the vent inspection stage 1402I may perform an inductive or vision inspection. In one embodiment, an inductive sensor is used to determine whether the material of the vent has actually left. In one embodiment, a camera and/or light source is used to determine whether sufficient light is passing through the location where the vent should be.

A head forming module 410 may include a stem extract stage 1402J. In one embodiment, the stem extract stage 1402J includes extracting a cartridge case from a die nest. In one embodiment, a stem is actuated to force the cartridge case from the die nest. For example, the stem 1508 of FIG. 150 may be actuated to push the cartridge case up and out of the die nest 1502. In one embodiment, the stem 1508 may be hydraulically actuated. In one embodiment, it may take hundreds or thousands of pounds of force to force the cartridge case 1506 out of the die nest 1502.

A head forming module 410 may include an offload stage 1402K. In one embodiment, a cartridge case may be transferred from the first dial table 1402 to the first chuck dial 1404.

In one embodiment, a cartridge case may remain in an open end down orientation. In one embodiment, orientation with an open end down may limit chances of objects, debris, or other materials from falling into the cartridge case.

A head forming module 410 may include a lubrication step 1402L. In one embodiment, a lubrication step 1402 L may include lubricating a stem and or die nest. In one embodiment, lubrication may prepare a stem and/or die nest for receipt of a new cartridge case. In one embodiment, the lubrication step 1402L shortly precedes an onload stage 1402A and allows lubrication to be placed between a stem and/or die nest and a new cartridge case. In one embodiment, without lubrication, cartridge cases may become lodged in a die nest and/or on a stem and may become difficult to remove.

The exemplary stages 1402A-1402L discussed above are exemplary only. In some embodiments, two or more stages may be combined into a single stage. One of skill in the art will recognize significant variation without departing from the scope and content of the current disclosure.

According to one embodiment, after the head forming module 1402 hands of a cartridge case to the extractor groove module 412. In one embodiment, the extractor groove module includes a first chuck dial 1404 and a second chuck dial 1406. In one embodiment, the first chuck dial 1404 receives a cartridge case from the first dial table 1402 and provides the cartridge case to an extractor groove chuck. In one embodiment, the second chuck dial 1406 receives a cartridge case from the extractor groove chuck and provides the cartridge case to the second dial table 1408.

Figure 17:
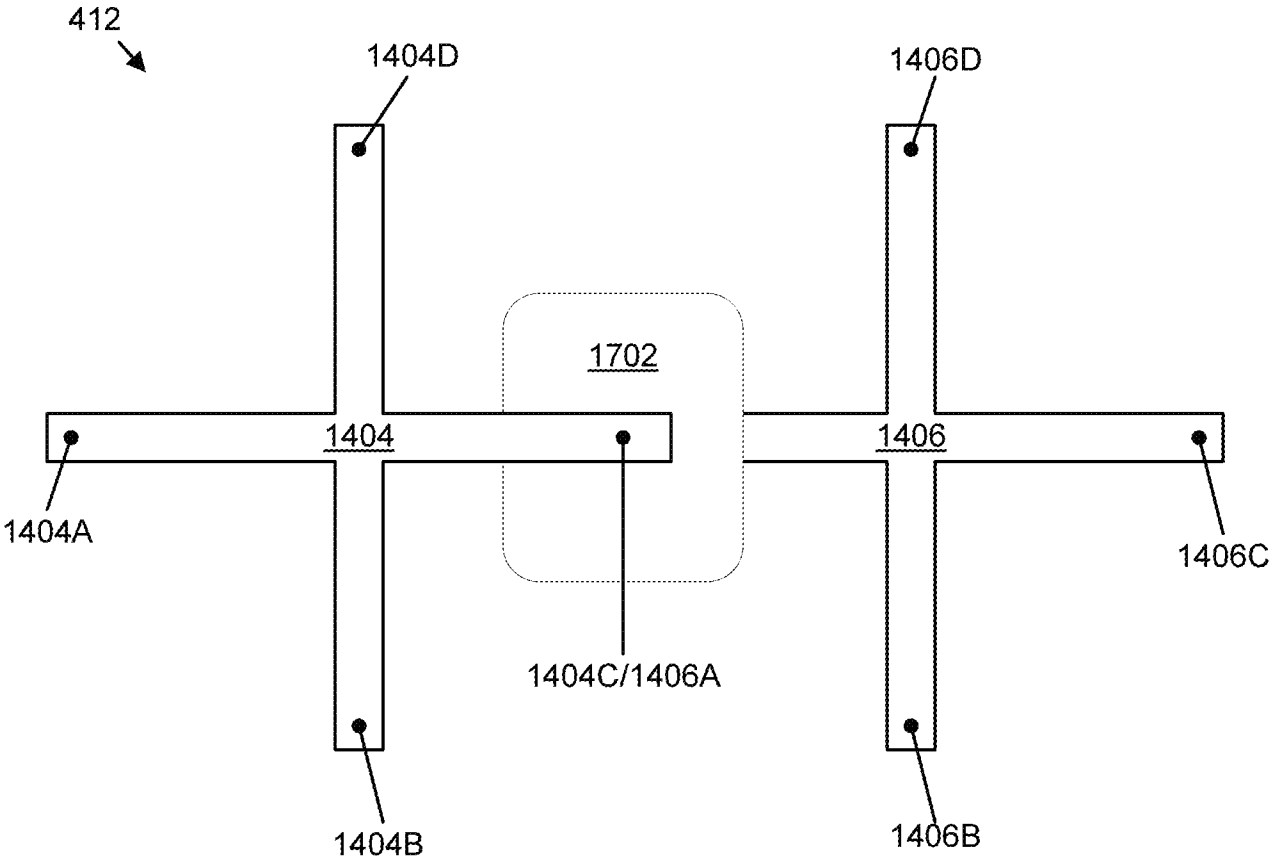
FIG. 17 illustrate a plan view of an extractor groove module in accordance with the present invention.

Turning now to FIG. 17 a simplified plan view of an extractor groove module 412 is shown. The extractor groove module 412 includes a first chuck dial 1404, a second chuck dial 1406, and an extractor groove chuck 1702. The plan view of FIG. 17 is simplified for clarity of discussion and illustration. According to one embodiment, the extractor groove module 412 is situated between a first dial table 1402 and a second dial table 1408.

The extractor groove module 412 may include a first chuck dial 1404. The first chuck dial 1404 may include a plurality of stages 1404A-1404D. In one embodiment, a step for forming an extractor groove may be performed at one or more of the stages 1404A-1404D. In one embodiment, a cartridge case may be moved sequentially through one or more of the stages 1404A-1404D. In one embodiment, the first chuck dial 1404 rotates ninety degrees at a time in a counter-clockwise direction.

The first chuck dial 1404 may include an onload stage 1404A. In one embodiment, the onload stage 1404A corresponds to the offload stage 1402K of the first dial table 1402. In one embodiment, a cartridge case is transferred from the first dial table 1402 to the first chuck dial 1404 the onload stage 1404A.

The first chuck dial 1404 may include a positioning stage 1404B. In one embodiment, the positioning stage 1404B adjusts a position of a cartridge case to a desired position. In one embodiment, the vertical position of the cartridge case is adjusted. In one embodiment, a mechanism forces a cartridge case against a hard stop so that the cartridge case is in a desired position.

In one embodiment, the positioning stage 1404B also includes a reject step. In one embodiment, if a cartridge case has failed any prior testing or inspection, the cartridge case may be discarded and rejected at the positioning stage 1404B. For example, if the cartridge case failed one or more inspections or tests performed in the annealing module 404 or head forming module 410 the cartridge case may be release from the first chuck dial at stage 1404B. In one embodiment, if a cartridge case has failed an anneal, pocket inspection, head inspection, vent inspection, or any other prior test or inspection, the cartridge case may remain on the stem and may be released from first chuck dial 1404. In one embodiment, cartridge cases that have failed a test may be discarded into a reject container or other container. In one embodiment, an operator may then inspect discarded cartridge cases to determine what caused the error, etc.

The first chuck dial 1404 may include a groove forming stage 1404C/1406A. In one embodiment, the groove forming stage 1404C/1406A includes placing a cartridge case in an extractor groove chuck 1702, turning the cartridge case against a blade to form an extractor groove, and placing the cartridge case on the second chuck dial 1406. In one embodiment, the cartridge case moves vertically downward from the first chuck dial 1404, to the extractor groove chuck 1702, and through the extractor groove chuck 1702 to the second chuck dial 1406. In one embodiment, the extractor groove chuck 1702 comprises a through-hole chuck which allows a cartridge case to be removed from the chuck and placed in the chuck at approximately the same time.

Figure 18:
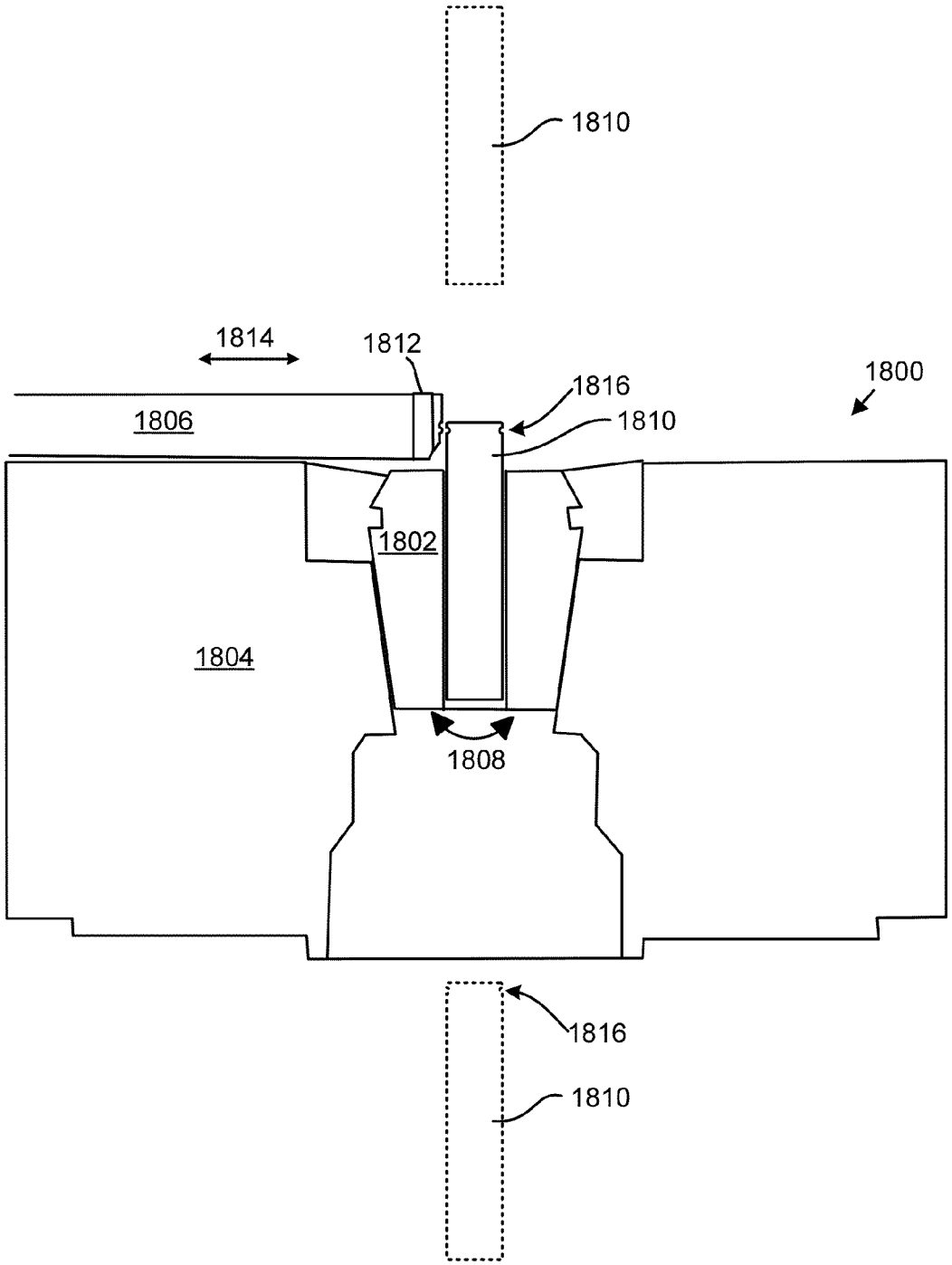
FIG. 18 illustrates a simplified cross-sectional view of one embodiment of a through-hole chuck assembly in accordance with the present invention.

FIG. 18 illustrates a simplified cross-sectional view of one embodiment of a through-hole chuck assembly 1800. In one embodiment, the through-hole chuck assembly 1800 may be used to create an extractor groove on a cartridge casing. In the depicted embodiment, the through-hole chuck assembly 1800 includes a through-hole chuck 1802, a chuck casing 1804, and an actuator arm 1806.

In one embodiment, the through-hole chuck 1802 is configured to rotate relative to the chuck casing 1804 in the direction indicated by arrow 1808. For example, a motor, belt, and/or another drive mechanism may be used to impart rotational force to the chuck 1802. In one embodiment, the chuck 1802 may be configured to engage a cartridge case 1810. In one embodiment an inside diameter of the chuck 1802 may be adjustable to selectively engage a cartridge case. In one embodiment, the chuck 1802 may be selectively adjusted to engage and disengage a cartridge case. In one embodiment, the chuck 1802 may be used to engage a cartridge case and then rotate the cartridge case 1810.

The actuator arm 1806 may include blade 1812 for engaging a rotating cartridge case 1810. In one embodiment, the actuator arm 1806 may actuate in the direction indicated by arrow 1814 to selectively engage the cartridge case. In one embodiment, the blade 1812 includes geometry for forming a desired extractor groove shape.

Exemplary positions of a cartridge case 1810 are illustrated above and below the through-hole chuck 1810. In one embodiment, a cartridge case 1810 may be placed in the chuck 1802 from a position above the chuck assembly 1800 by a first chuck dial 1804. In one embodiment, as a first chuck dial 1804 places a cartridge case 1810 into the chuck 1802 the chuck 1802 may engage the cartridge case 1810. The chuck may begin to rotate the cartridge case and the actuator arm 1806 may actuate the blade 1812 against the cartridge case 1810 to form the extractor groove 1816. In one embodiment a vacuum may be used to collect chips or material cut from the cartridge case.

In one embodiment, following rotation of the cartridge case and forming of the extractor groove 1816, the chuck 1802 may release the cartridge case 1810 so that it continues downward to a position below the chuck assembly 1800. In one embodiment, the second chuck dial 1406 may receive the cartridge case 1810 as it is released by the chuck 1802. In one embodiment, as a cartridge case 1810 is being released out the bottom of the chuck 1802 another cartridge case 1802 may be inserted from above.

In one embodiment, a through-hole chuck may increase how quickly an extractor groove 1816 may be formed in a cartridge case. For example, an extractor groove forming step may not be required to wait for a cartridge case 1810 to be pulled back out of a chuck but may simply insert an additional cartridge case as a previous one is released out another opening.

In one embodiment, a through-hole chuck may be purchased and configured for use in the manner shown and discussed in relation to FIG. 18. For example, Jato Precision in Taiwan sells a JAM-25 chuck model which may be used in the manner discussed above.

Figure 16D:
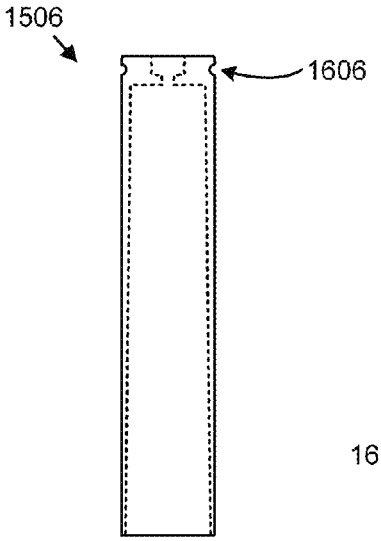

FIG. 16D illustrates exemplary shape and configuration in a cartridge case after being turned by the extractor groove chuck. Particularly, the cartridge case 1506 includes an extractor groove 1606.

Returning to FIG. 17 a cartridge case at the groove forming stage 1404C/1406A may have passed to the second chuck dial 1406. Thus, in one embodiment, the first chuck dial 1404 may include an empty final stage 1404D because a cartridge case may already have been passed off through the extractor groove chuck 1702 to the second chick dial.

In one embodiment, the second chuck dial 1406 may, similar to the first chuck dial 1406, sequentially rotate in a counter-clockwise direction and thus move a cartridge case through one or more of the stages 1406A-1406D.

In one embodiment, the second chuck dial 1406 may include an inspection stage 1406B. In one embodiment, the inspection stage 1406B may include a vision inspection of a cartridge case. In one embodiment, the vision inspection may include using a camera that takes a picture of a profile of a cartridge case against a backlit background. In one embodiment, a check for burrs or other irregularities on the cartridge case may be performed. In one embodiment, concentricity of the cartridge case as well as the extractor groove may be performed.

In one embodiment, a cartridge case may be rotated around its axis 90 degrees and a second image of the cartridge case analyzed. In one embodiment, offset pictures of the cartridge case may reduce the number of false rejects due to particles or burrs on a surface of a profile of the cartridge case.

The second chuck dial 1406 may include an offload stage 1406C. In one embodiment, a cartridge case may be passed form the second chuck dial 1406 to the second dial table 1408. In one embodiment, if a cartridge case has failed the inspection step of the inspection stage 1406B the cartridge case may be retained on the second dial chuck 1406 and may not be passed onto the second dial table 1408.

The second chuck dial 1406 may include a reject stage 1406D where rejected cartridge cases may be offloaded the second chuck dial 1406. In one embodiment, cartridge cases that have failed an inspection stage 1406B may be retained on the second chuck dial 1406 during an offload stage 1406C to the second dial table. In one embodiment, failed cartridge cases may by offloaded at the reject stage 1406 into a bin. In one embodiment, an operator may be able to examine cartridge case which have been rejected at the rejection stage 1406D. In one embodiment, the operator may know that the cartridge cases in the bin at that stage may be due to rejections based on the inspection at the inspection stage 1406B. For example, cartridge cases that had failed former tests and inspection may have already been offloaded at the position stage 1404B of the first chuck dial 1404. Thus an operator may be able to do determine what problems there may be with the extractor groove chuck 1702 or chuck assembly 1800 based on the cartridge cases in that bin.

Returning to FIG. 14 a second dial table 1408 is shown. The second dial table 1402 may include a plurality of stages 1408A-1408L where one or more forming steps are formed on a cartridge case. In the one embodiment, the second dial table 1408 and the machinery for implementing the forming steps at one or more of the stages 1408A-1408L may be comprised in a tape module 414. In one embodiment, the second dial table 1408 includes twelve stages 1408A-1408L and rotates one twelfth of a rotation at a time. At each stage one or more steps may be performed on a cartridge case. For example, a cartridge case may be loaded on at one stage and may rotate with the table through one or more of the remaining stages where one or more forming steps are performed. Exemplary steps and processes that occur at each stage 1408A-1408L will now be discussed.

A taper module 414 may include an onload stage 1408A. In one embodiment, the onload stage 1408A may correspond to the offload stage 1406C of the second chuck dial 1406. In one embodiment, a rod may extend upwards from beneath the offload stage 1406C and move a cartridge case into a die nest of the onload stage 1408. In one embodiment, the onload stage 1408A may receive the cartridge case. In one embodiment, a die nest of the onload stage 1408A may include a grasping mechanism for grasping the cartridge case. In one embodiment, the rod that moved the cartridge case into the onload stage 1408A may retract and the grasping mechanism of the onload stage may retain the cartridge case in the onload stage 1408. In one embodiment, the grasping mechanism may grasp the cartridge case by an extractor groove.

In one embodiment, the second dial table 1408 and its stages 1408A-1408L may maintain a cartridge case in a head up position. In other words, the second dial table 1408 may maintain a cartridge case such that an open end of the cartridge case faces downwards. In one embodiment, this may limit debris falling into the cartridge case. In one embodiment, keeping debris from falling into the cartridge case may be important when neck taper steps are taken because the debris may not be removable one a neck is tapered.

In one embodiment, the onload stage 1408A may include applying a lubricant to the cartridge case. In one embodiment, a precise amount of lubricant is needed to precisely form a cartridge case. In one embodiment, a lubricant may reduce the amount of force needed to create a tapered neck and/or may allow a more smooth and desirable taper to be performed.

A taper module 414 may include an empty stage 1408B.

A taper module 414 may include a first taper stage 1408C. In one embodiment, the first taper stage 1408C includes a first taper press. In one embodiment, the first taper press includes forcing a taper tool upwards against the cartridge case and/or the die nest to alter a shape of the cartridge case. In one embodiment, a servo motor is used for high resolution accuracy in positioning the taper tool in relation to the die nest and/or cartridge case.

In one embodiment, a cartridge case may be formed to meet the requirements of a particular type of cartridge. For example, a cartridge case may be formed to meet the requirements of the data sheet of FIG. 13. In one embodiment, the tolerances on the location of the taper of the cartridge case are high and can be quite difficult to reach. In one embodiment, a variety of factors, including the shape of the tooling surfaces which contact the cartridge case, affect how a taper is formed and how accurately the dimensions of the taper meet requirements. Exemplary factors include the amount and type of lube on the cartridge case, the wall thickness of the cartridge case, the hardness of the cartridge case, the grain structure of the material of the cartridge case, and the ambient temperature of a machine or operating environment.

In one embodiment, each of the factors may vary slightly over time and between cartridge cases and even slight changes in a couple of these factors may lead to neck tapers that do not meet required standards. In one embodiment, if the neck taper does not meet required standards a cartridge case must be rejected and may become scrap.

A taper module 414 may include an empty stage 1408D.

A taper module 414 may include a second taper stage 1408E. In one embodiment, only a single taper stage may be needed. In one embodiment, two, three, or more taper stages are needed to accurately form a cartridge case.

Figure 19C:
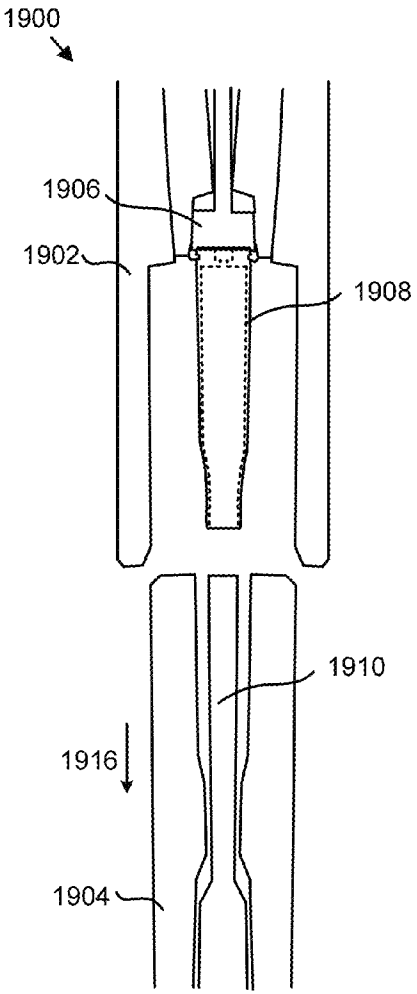
FIGS. 19A-19C illustrates one embodiment of taper tooling at different points within a taper step in accordance with the present invention.
Figure 19B:
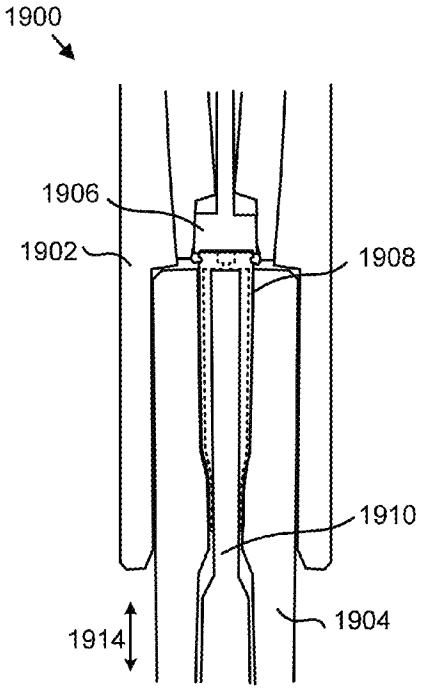
Figure 19A:
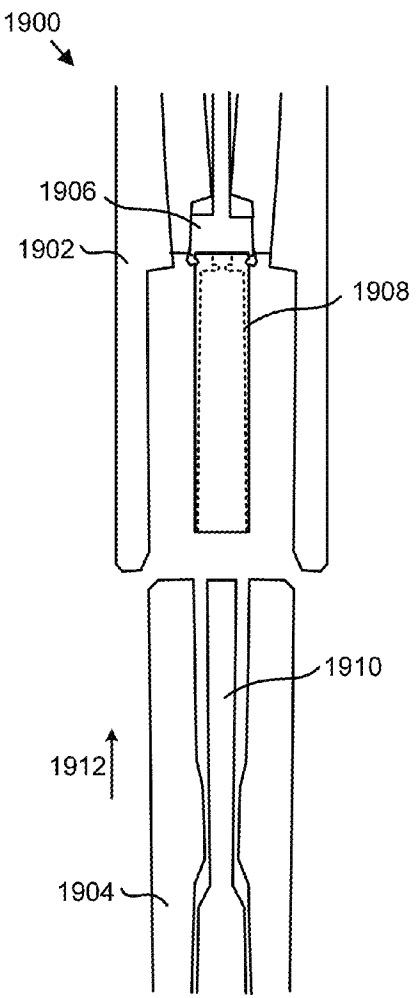

FIGS. 19A, 19B, and 19C illustrate one embodiment of taper tooling 1900 for a taper stage. The taper tooling 1900 may be similar to tooling used in a first, second, and/or third taper stage 1408C, 1408E, 1408G. In one embodiment, dimensions between taper tooling may vary to progressively shape a cartridge case into a desired shape or dimension. In the depicted embodiment, the taper tooling 1900 may include a die nest 1902 and a taper tool 1904.

The die nest 1902 may include a grasping mechanism 1906. The grasping mechanism 1906 may grasp a cartridge case 1908 and retain the cartridge case 1908 within the die nest 1902. In one embodiment, the grasping mechanism 1906 grasps a cartridge case 1908 by an extractor groove. The die nest 1902 may include a geometry for receiving a taper tool 1904. Similar to the die nest 1902 and the ponch tool 1504 of FIG. 15, the die nest 1902 may guide the taper tool 1904 such that a desired alignment between the taper tool 1904, die nest, and/or cartridge case 1908 is achieved.

The taper tool 1904 may include a geometry for engaging an external surface of the cartridge case 1908. The taper tool 1904 may include a stem 1910 that engages an internal surface of the cartridge case. In one embodiment, the stem 1910 may form a desired inside diameter of a tapered portion of the cartridge case 1908. In one embodiment, the taper tool 1904 may press a portion of the cartridge case 1908 into a tapered portion around the stem 1910. In one embodiment, the taper tool 1904 and stem 1910 may be moved independently of each other. In one embodiment, independent moving of the taper tool 1904 and stem 1910 may allow for adjustment in a taper process.

Each of the FIGS. 19A, 19B, and 19C illustrate the taper tooling 1900 and cartridge case 1908 at different points within a tapering stage. FIG. 19A illustrates the tapered tooling 1900 prior to a press operation. The taper tool 1904 is external to the die nest 1902. The cartridge case 1908 is shown having no taper. The arrow 1912 indicates that the taper tool 1904 is being forced in an upward direction towards the die nest 1902 and cartridge case 1908.

FIG. 19B illustrates the taper tool 1904 within the die nest 1902. The stem 1910 is shown within the cartridge case 1908. The taper tool 1904 is engaging an outer surface of the cartridge case 1908 and forming a taper on the case. The arrows 1914 illustrate that the taper tool 1904 may be moved in a vertical direction to adjust the location and/or shape of a taper formed on the cartridge case.

FIG. 19C illustrates the cartridge case 1908 after the taper tool 1904 and stem 1910 have been removed from the die nest and cartridge case 1908. The cartridge case 1908 is shown having an altered geometry that include a tapered neck. Arrow 1916 indicates that the taper tool 1904 has been moved downward to disengage from the cartridge case 1908 and the die nest 1902.

Returning to FIG. 14, a taper module 414 may include a mouth lube stage 1408F. In one embodiment, the mouth lube stage 1408F places lube on a mouth of a cartridge case. In one embodiment, the lube is placed in preparation for a final taper forming step to give the taper of the cartridge its final dimensions. In one embodiment, lube may have been lost during previous stages and may be needed for a final stage.

A taper module 414 may include a third taper stage 1408G. In one embodiment, the third taper stage 1408G includes a third taper press step configured to form a cartridge case into its final dimensions. In one embodiment, a press machine may include taper tooling similar to that depicted in FIG. 19.

Figure 16E:
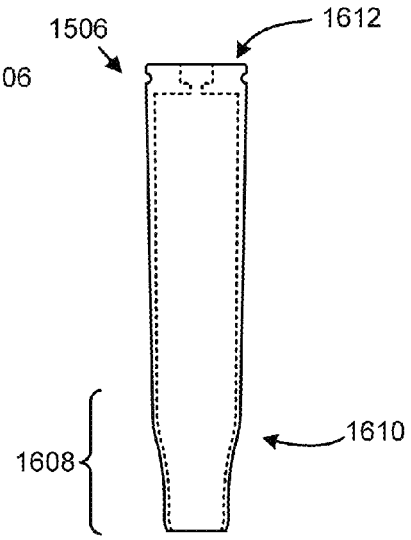

FIG. 16E illustrates a cartridge case 1506 with a tapered neck 1608. In one embodiment, the cartridge case 1506 includes a taper shoulder 1610 and a head end 1612. In one embodiment, the cartridge case 1506 and the tapered neck 1608 meets the requirements of a specific cartridge type. For example, the cartridge case 1506 and tapered neck 1608 may meet the dimension requirements illustrated in the data sheet of FIG. 13. In one embodiment, the cartridge case 1506 meets a required head to shoulder distance. The head to shoulder distance may include the distance between the taper shoulder 1610 and the head end 1612.

Returning to FIG. 14, a taper module 414 may include a taper inspection stage 1408G. The taper inspection stage 1408H may inspect one or more dimensions of a taper of a cartridge case. In one embodiment, the inspection stage 1408 includes a contact tooling inspection of one or more dimensions of the cartridge case. In one embodiment, the inspection is performed using contact tooling that is linked to a linear transducer. In one embodiment, the contact tooling may clamp or contact the outside of the cartridge case at one or more locations to determine the cartridge case's dimensions. For example, the contact tooling may include calipers or any other type of contact tooling for measuring one or more dimensions of cartridge case. Some embodiments may include camera inspection or any other type of inspection. In one embodiment, the inspection stage 1408 includes an inspection of the head to shoulder distance. In one embodiment, this distance may be logged and/or stored. In one embodiment, a cartridge case that has a taper dimension outside of a required range may be recorded as a reject and rejected at a later stage. For example, if a cartridge case has a head to shoulder distance that is too long or too short according to a required range, the cartridge case may be rejected.

In one embodiment, an inspection at the inspection stage 1408H may be used to adjust one or more of the taper stages 1408C, 1408E, 1408G. In one embodiment, a dimension of a cartridge case may be inspected and recorded. In one embodiment, if the dimensions of the cartridge case varies from an ideal dimension size the one of the taper stages 1408C, 1408E, 1408G may be adjusted to correct the variation. In one embodiment, the adjustment may be made if a cartridge case fails the inspection at the inspection stage 1408H. For example, if one or more cartridge cases fails as a dimension outside a required range the cartridge cases may fail and a previous taper stage 1408C, 1408E, 1408G may be changed to correct the error. In one embodiment, the adjustment may be made even if a cartridge case passes the inspection. For example, the dimension of a cartridge case may be within an acceptable range but may be close to an unacceptable range.

In one embodiment, an average of dimensions may be used to determine an adjustment should be made. In one embodiment, an inspection stage may record a dimension for onehundred cartridge cases. If the average is above or below an ideal dimension a step at one of the taper stages 1408C, 1408E, 1408G may be adjusted. In one embodiment, if a dimension begins to drift in a general direction, for example if a dimension is trending towards a larger size, the taper stages 1408C, 1408E, 1408G may be adjusted to counteract the drift.

A taper module 414 may include a length trim stage 1408I. In one embodiment, the length trim stage 1408I trims a length of a cartridge case to fall within a required range. In one embodiment, the length trim stage 1408I may include cutting a portion of the tapered neck from a cartridge case such that the end to end length is correct. The length trim stage 1408I may use a reciprocating blade, rotating blade, or any cutter known in the art for trimming a length of a cartridge case.

A taper module 414 may include a length inspection stage 1408J. The length inspection stage 1408J may inspect a length of a cartridge case to determine if it falls within a proper length range.

A taper module 414 may include an offload stage 1408K. In one embodiment, the offload stage 1408K may offload a cartridge case from the second dial table 1408. In one embodiment, a grasping mechanism may release a cartridge case. In one embodiment, a cartridge case may be discarded into a bin, onto a conveyor, or other receiving mechanism.

In one embodiment, an offload stage 1408K may include selectively directing cartridge cases to two or more locations. In one embodiment, cartridge cases may be directed to a reject location. For example, if a cartridge case has failed a taper inspection, length inspection, or other inspection or test, the cartridge case may be directed to a reject bin or reject location. In one embodiment, cartridge cases may be directed to a pass location. For example, if a cartridge case has passed all the inspections and/or tests the cartridge case may be directed to a pass bin, conveyor belt, or other location. In one embodiment, a passing cartridge case may be directed to a conveyor, such as the conveyor 306 of FIG. 3. In one embodiment, the cartridge case may be carried by the conveyor 306 to another system, such as a washing system 104 or an annealing system 106.

In one embodiment, a cartridge case may be directed to a quality check location. For example, even cases that have passed an inspection or test may be directed to a quality check location so that one or more requirements for a cartridge case can be tested. For example, it may be desirable to inspect cartridge cases independently from any tests or inspection of the forming system 102 to double check that everything, include tests and inspections, are working properly.

In one embodiment, the offload stage 1408K may include selectively offloading a cartridge case based on one or more tests, inspections, and/rules. In one embodiment, a rule may determine when cartridge cases that have passed inspections and/or tests may be provided to a quality control location. For example, a rule may specify that one for every one-thousand passing cartridge cases must be directed to a quality control location. Alternatively, or additionally, an operator may direct that a next N number of cartridge cases be directed to a quality control location.

A taper module 414 may include an empty stage 1408L. In one embodiment, stage 1408L is empty because all cartridge cases have been offloaded in the offload step 1408K. In one embodiment, one or more steps may be taken to prepare the dial table at the empty stage 1408L to receive a new cartridge case.

The forming system 102 may include a control cabinet 1410. In one embodiment, the control cabinet 1410 includes software, hardware, and/or circuitry for controlling one or more aspects of the forming system 102.

In one embodiment, the control cabinet 1410 may control a stage interval for the stages of the forming system 102. In one embodiment, the stage interval controls when cartridge cases are transferred to a next stage. In one embodiment, the control cabinet 1410 may poll one or more devices at one or more stages to determine whether steps have been completed. In one embodiment, each stage that includes a forming or inspecting step may be polled to determine that the steps of the stage have been completed. In one embodiment, when each stage has reported that the steps of the stage have been completed the control cabinet 1410 may initiate a transfer step. In one embodiment, the transfer step may include transferring each cartridge case to a next step. For example, a transfer step may include the first dial table 1402, first chuck dial 1404, second chuck dial 1406, and second dial table 1406 rotating such that a cartridge case is moved to a next stage.

In one embodiment, the control cabinet 1410 may control one or more aspects of steps performed at one or more stages. In one embodiment, the control cabinet 1410 may store settings for mechanisms or devices that perform steps. For example, a press may have settings stored in the control cabinet 1410 which control the operation of the press. For example, the settings may include a number of rotations for a servo motor, a desired amount of force that needs to be created, and/or other settings. In one embodiment, any aspect of the tests discussed in this application may be stored as a setting by the control cabinet 1410.

The forming system 102 may include a human machine interface 1412. In one embodiment, the human machine interface 1412 may allow an operator to control one or more aspects of the forming system 102. In one embodiment, the human machine interface 1412 may include a display screen and/or an input device for controlling operation of the forming system 102. In one embodiment, the human machine interface 1412 may allow an operator to adjust one or more settings for each of the stages, pause operation, or a variety of other settings. In one embodiment, the human machine interface 1412 may allow an operator to may allow an operator to communicate with the control cabinet 1412 and/or monitor operation of the forming system 102.

In one embodiment, the control cabinet 1410 and/or a human machine interface 1412 may be remotely accessible over a network. For example, the control cabinet 1410 may include a communication connection which allows an individual to communicate with the forming system 102 from a remote location. In one embodiment, an operator may be able to monitor the forming system 102 and or adjust settings for one or more steps or stages of the forming system 102.

Returning to FIG. 1, a cartridge case manufacturing system 100 may include an anneal system 106. In one embodiment, the anneal system 106 performs one or more final annealing steps. In one embodiment, the steps performed by the anneal system 106 may create a desired hardness and/or strength in one or more portions of a cartridge case. As previously discussed, an annealing module 406 may be included in the case forming system 102. In one embodiment, the anneal system 106 may perform one or more annealing steps in addition to the annealing module 406.

Figure 20:
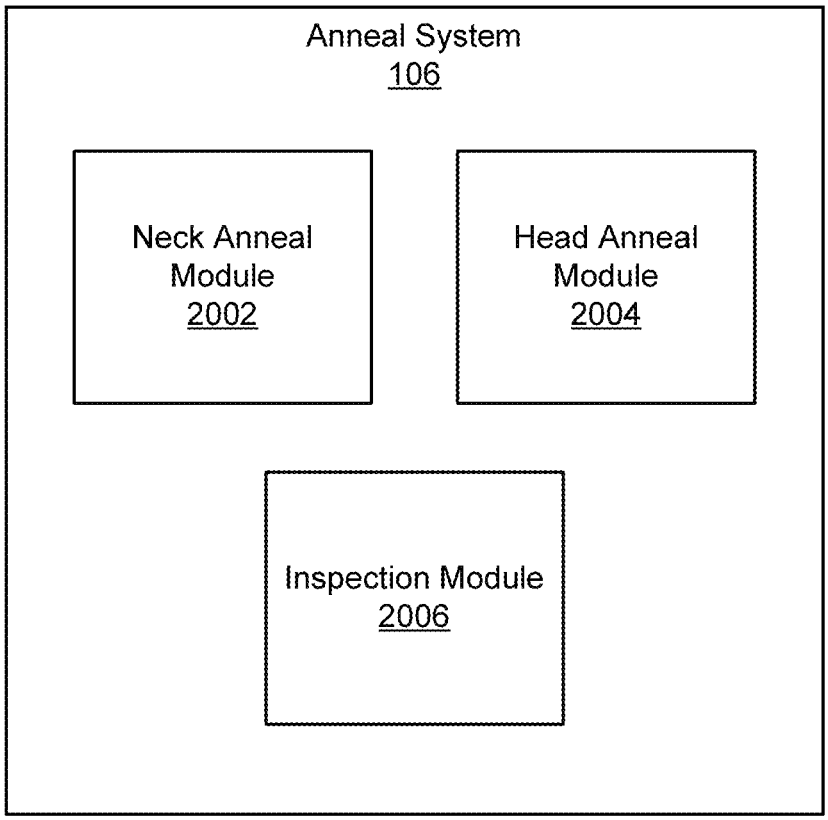
FIG. 20 is schematic block diagram illustrating one embodiment of an anneal system in accordance with the present invention.

FIG. 20 illustrates a schematic block diagram of one embodiment of an anneal system 106. In the depicted embodiment, the anneal system 106 includes a neck anneal module 2002, a head anneal module 2004, and an inspection module 2006.

The neck anneal module 2002 may perform an anneal on a neck portion of a cartridge case. In one embodiment, the neck anneal module 2002 may heat a neck portion to a different temperature than the remainder of the cartridge case. In one embodiment, a neck portion of the cartridge case may be surrounded by an inductive coil and heated in a manner similar to that discussed in relation to the annealing module 404.

In one embodiment, the neck anneal module 2002 may anneal a single cartridge case at a time. In one embodiment, the neck anneal module 2002 may include a through-hole annealing chamber. In one embodiment, the neck anneal module 2002 may include a single diameter annealing coil or a varying diameter annealing coil. In one embodiment, only a single diameter coil may be needed and only a portion of a cartridge case may be inserted into the single diameter coil. According to varying embodiments, any of the variations discussed in relation to the annealing module 404 may also be used in the neck anneal module 2002.

In one embodiment, the neck anneal module 2002 may be used to anneal a neck of a cartridge case. In one embodiment, this may be desirable to gain a desired softness or hardness in the tapered neck of a cartridge case. In one embodiment, the anneal may be used to relieve stress within the material of the tapered neck. For example, the taper forming steps of the taper module 414 may cause stress within the material of the neck. The stress within the neck may cause the neck to be more brittle and/or subject to cracking. In one embodiment, heating the neck may reduce this stress and/or change the hardness of the material of the neck.

In one embodiment, the anneal system 106 may include a head anneal module 2004. The head anneal module 2004 may be configured to anneal a head portion of the cartridge case. In one embodiment, the head anneal module 2004 may heat a head portion to a different temperature than the remainder of the cartridge case. In one embodiment, a head portion of the cartridge case may be surrounded by an inductive coil and heated in a manner similar to that discussed in relation to the annealing module 404 and/or the neck anneal module 2002.

In one embodiment, the head anneal module 2004 may anneal a single cartridge case at a time. In one embodiment, the head anneal module 2004 may include a through-hole annealing chamber. In one embodiment, the head anneal module 2004 may include a single diameter annealing coil or a varying diameter annealing coil. In one embodiment, only a single diameter coil may be needed and only a portion of a cartridge case may be inserted into the single diameter coil. According to varying embodiments, any of the variations discussed in relation to the annealing module 404 may also be used in the head anneal module 2004.

In one embodiment, the head anneal module 2004 may be used to anneal a head of a cartridge case. In one embodiment, this may be desirable to gain a desired softness or hardness in the head of a cartridge case. In one embodiment, the anneal may be used to relieve stress within the material of the head. For example, the head forming steps of the head forming module 410 may cause stress within the material of the head. The stress within the neck may cause the neck to be more brittle and/or subject to cracking. In some embodiments, cracks or other irregularities may develop in the head without an annealing step. In one embodiment, heating the head may reduce this stress and/or change the hardness of the material of the neck.

The anneal system 106 may include an inspection module 2006. In one embodiment, the inspection module 2006 may include a temperature sensor which measures a temperature of a cartridge case at some point within the annealing system 106. In one embodiment, the temperature sensor may measure a portion of a cartridge case to verify that it has been properly treated. In one embodiment, a temperature sensor may measure a neck of a cartridge case following a neck anneal performed by the neck anneal module and measure a head of a cartridge following a head anneal performed by the head anneal module 204.

Figure 21:
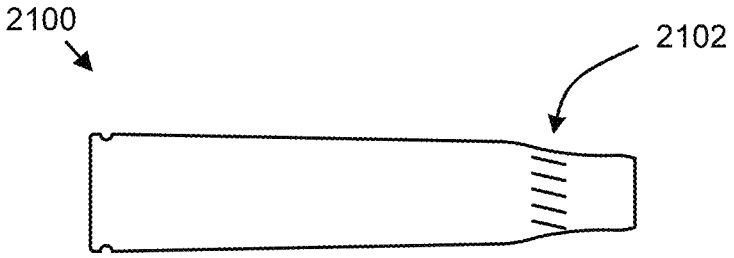
FIG. 21 illustrates a side view of one embodiment of a cartridge case following a neck anneal by a neck anneal module.

The inspection module 2006 may also include a vision inspection of a cartridge case. In one embodiment, a neck anneal performed by the neck anneal module may leave a heat-treat line if properly performed. FIG. 21 illustrates a side view of one embodiment of a cartridge case 2100 following a neck anneal by a neck anneal module 2002. The cartridge case 2100 includes a heat treat line 2102. In one embodiment, the inspection module 2006 may include a camera which inspects whether a heat-treat line exists, and or whether the heat treat line is at a proper location.

In one embodiment, a cartridge case may be passed between one or more of the modules 2002-2006 in a vertical downward direction. In one embodiment, for example, a cartridge case may be passed through an annealing chamber of a neck anneal module in a downward vertical direction to a head anneal module 2004. In one embodiment, a cartridge case is handled with a controlled orientation throughout the anneal system 106.

In one embodiment, the anneal system 106 may output a cartridge case to an output location. For example, the anneal system 106 may output a cartridge case to the output bit 310 of FIG. 3. In one embodiment, the anneal system 106 may direct cartridge cases that fail one or more tests or inspection of the inspection module 2006 to a location different from cartridge cases that pass all tests or inspections.

Figure 22:
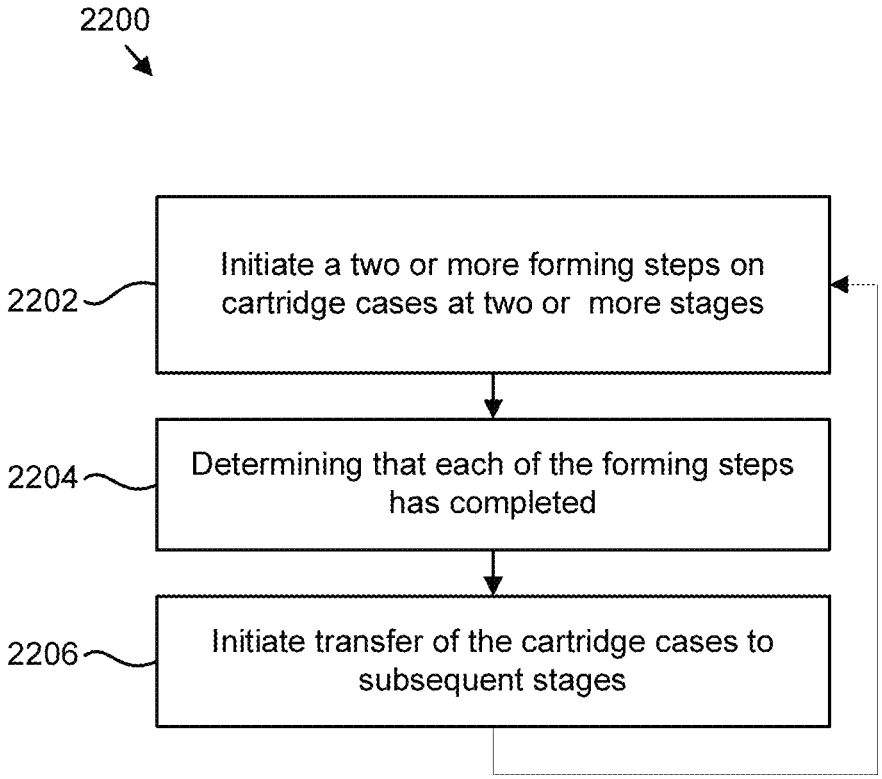
FIG. 22 is a schematic flow chart diagram illustrating a method for controlling a length of a stage interval in accordance with the present invention.

FIG. 22 is a schematic flow chart diagram illustrating one embodiment of a method 2200 for controlling a length of a stage interval. In one embodiment a stage interval is an amount of time between transfers of cartridge cases between stages. For example, a stage interval may be an amount of time between rotations of one of the dials 1402-1408 and/or the amount of time between cartridge cases being placed in an anneal module.

The method 2200 may include initiating 2202 two or more forming steps on cartridge cases at two or more stages. In one embodiment, a control cabinet 1410 may initiate one or more mechanism at one or more stages to begin respective forming steps. For example, presses, inductive coils, or test mechanisms may be activated to perform a forming or testing step.

The method 2200 may include determining 2204 that each of the forming steps has completed. In one embodiment, a control cabinet 1410 may poll devices at each of the stages to determine if they have completed their respective forming steps. In one embodiment, a device at each station may provide a signal to a control cabinet to indicate that the steps at the station are completed.

The method 2200 may include initiating 2206 a transfer of the cartridge cases to subsequent stages. In one embodiment, a control cabinet 1410 may provide a control signal to one or more stages, dial tables, annealing modules, and/or transfer mechanism to initiate a transfer between stages.

In one embodiment, following initiating 2206 of a transfer of cartridge case the method 220 may repeat by initiating 2202 forming steps. In one embodiment, the method 2200 may cycle through the steps 2202-2206 until an operator or device initiates a shutdown of a forming system 102 or cartridge case manufacturing system 100.

In one embodiment, a stage interval includes the amount of time between initiating 2206 transfer of cartridge cases between stages. In one embodiment, the stage interval may be less than ten seconds. In one embodiment, a stage interval may be less than three seconds. In one embodiment, a stage interval may be about two seconds. In one embodiment, a stage interval may be about one-point-four seconds. The stage interval may vary in length depending on a variety of factors including, but not limited to cartridge case size, cartridge case material, or any other factor.

Figure 23:
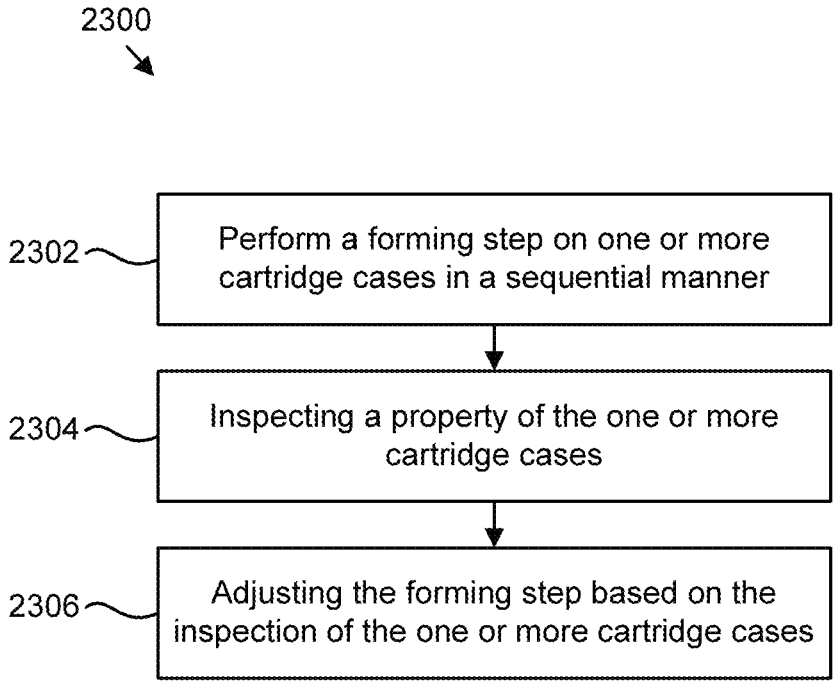
FIG. 23 is a schematic flow chart diagram illustrating a method for forming cartridge cases in accordance with the present invention.

FIG. 23 is a schematic flow chart diagram illustrating one embodiment of a method 2300 for forming a cartridge case. In one embodiment, the method 2300 may be used to adjust a forming step because of changes in ambient temperature of a device machine, or operating environment. The method 2300 may be used to adjust to variations in material of a cartridge case.

The method 2300 may include performing 2302 a forming step on one or more cartridge cases in a sequential manner. In one embodiment, the forming step performed 2302 may include an annealing step, a head forming step, a groove forming step, or a taper forming step. In one embodiment, the forming step may be sequentially performed 2302 on two or more cartridge cases. For example, the forming step may formed on a first cartridge case, then a second cartridge case, and so on until two or more cartridge cases have and the forming step performed 2302 on them.

The method 2300 may include inspecting 2304 a property of the one or more cartridge cases. In one embodiment, a temperature, dimension, or other property of a cartridge case may be inspected 2304. For example, a temperature of a cartridge case may be inspected 2304 following an anneal step or a dimension of a cartridge case may be inspected 2304 following a head forming, groove forming, or taper forming step.

In one embodiment, the inspection 2304 is sequentially formed following the performing 2302 of the forming step. For example, after a forming step has been performed 2302 on a first cartridge an inspection 2304 of the first cartridge may take place and a forming step may be performed 2302 on a second cartridge while the first cartridge is being inspected. In one embodiment, a result of an inspection may be logged or stored for later retrieval. For example, a dimension or temperature may be stored by the control cabinet 1410 for later reference.

The method 2300 may include adjusting 2306 the forming step based on the inspection of the one or more cartridge cases. In one embodiment, a setting for a press, anneal module, or other device may be adjusted based on the inspection 2304. For example, if an inspection reveals that a taper dimension is too large, a setting for a press that forms the taper dimension may be adjusted. The setting may include the amount of force the press should provide, a rotation of a servo motor, or other setting. This changed setting may then create a taper dimension that is no longer too large.

In one embodiment, the adjustment 2306 may be based on a result of an inspection not meeting a requirement. For example, a cartridge case may be required to have a taper dimension within a specific range. If the result of an inspection is outside this range a forming step may be adjusted 2306 to correctly form later cartridge cases.

In one embodiment, an adjustment 2306 may be made even though a result meets a requirement. For example, if a result indicates that a dimension of a cartridge case is drifting in a direction such that the it appears that the dimension will begin to fail in the future, an adjustment will be made to reduce the drift. For example, if a series of cartridge cases are formed by a forming step and a dimension is generally increasing over time, an adjustment may be made to slow down the increase or to begin decreasing the dimension.

In one embodiment, the adjustment 2306 may be based on a result of inspecting 2304 a single cartridge case. In one embodiment, the adjustment 2306 may be based on an average of results for two or more cartridge case. For example, the dimensions of ten cartridge cases may be averaged and this average may be used to determine an adjustment. In one embodiment, an adjustment 2306 may be based on a trend for a specific dimension. For example, if a specific dimension appears to be decreasing over time an adjustment may be made to slow the decrease of that dimension or to begin to increase the dimension.

In one embodiment, the method 2300 may allow a forming system 102 to accommodate a variety of operating variables when forming cartridge cases. For examples, ambient temperatures may cause dimensions of a press or a cartridge case to vary. Additionally, the material of cartridge cases may vary. For example, a first lot of cartridge cases may be formed of brass having a specific hardness while a second lot of cartridge cases may be formed of brass having a varying hardness. The adjustment of a forming step may allow cartridge cases to be formed within requirements despite such variations. Additionally, by adjusting a forming step before any cartridge cases fail money and time may be saved.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for forming a cartridge case comprising:

a series of modules, each module occupying a sequential location in the system, and each module performing a process step, wherein each process step is performed on a single cartridge case at a time and is synchronized to occur within a substantially simultaneous interval, the modules comprising an annealing module configured to individually anneal each cartridge case, a head forming module configured to individually form a head of each cartridge case, and a taper module configured to individually form a tapered neck of each cartridge case: and one or more conveyors configured to sequentially transfer each cartridge case through the series of modules and wherein each cartridge case is maintained with a controlled orientation within and between the series of modules by the one or more conveyors.

2. The system of claim 1, wherein the distance traveled between modules is less than twelve feet.

3. The system of claim 1, wherein the head forming module comprises a press actuated by a servo motor.

4. The system of claim 3, wherein the press comprises a die nest and the cartridge case is seated in the die nest during press forming, and wherein the die nest is monitored by a load cell.

5. The system of claim 1, wherein the simultaneous interval has a duration determined by the completion of one or more process steps.

6. The system of claim 1, wherein at least one of the modules is configured to determine whether a cartridge case passes or fails a testing criterion.

7. The system of claim 6, further comprising an output module configured to selectively output the cartridge case to one of:

a fail location;

a pass location; and a quality control location.

8. The system of claim 1, wherein the cartridge case is maintained with an open side down in the taper module.

9. The system of claim 1, wherein the cartridge case is maintained with an open side down within and between the head forming module and the taper module.

10. The system of claim 1, wherein at least one of the modules is configured to take a first picture of a cartridge case, rotate the cartridge case by about 90 degrees, and take a second picture of the cartridge case.

11. The system of claim 1, wherein maintaining the cartridge case in a controlled orientation comprises controlling the orientation of the cartridge case regardless of whether the cartridge case remains in an identical orientation.

12. The system of claim 1, wherein the series of modules further comprises an extractor groove forming module.

13. The system of claim 1, wherein the annealing module comprises an inductive coil and a coil insert, the insert encompassing the sides of an annealing chamber.

14. The system of claim 13, wherein the coil insert is constructed of a non-conductive or non-magnetic material.

15. The system of claim 13, the annealing module further comprising a casing enclosing and supporting the inductive coil.

16. The system of claim 15, wherein the casing is constructed of a non-conductive or non-magnetic material.

17. The system of claim 13, wherein the annealing chamber comprises a first opening and a second opening, wherein a cartridge case is allowed to pass into the annealing chamber through the first opening and out of the annealing chamber through the second opening.

18. The system of claim 17, further comprising a release mechanism at the second opening of the annealing chamber.

* * * * *